US005425404A

United States Patent [19]

Dyer

[11] Patent Number: 5,425,404

[45] Date of Patent: Jun. 20, 1995

[54] GRAVITY FEED FLUID DISPENSING SYSTEM

[75] Inventor: John J. Dyer, Shoreview, Minn.

[73] Assignee: Minnesota Mining and Manufacturing Company, St. Paul, Minn.

[21] Appl. No.: 50,529

[22] Filed: Apr. 20, 1993

[51] Int. Cl.[6] ..... B67D 1/00

[52] U.S. Cl. ..... 141/351; 141/21; 141/291; 141/293; 141/307; 141/309; 141/362; 141/363; 141/349; 141/339; 222/129.1; 222/145.5; 222/185; 222/325

[58] Field of Search ..... 141/2, 9, 18, 21, 22, 141/29, 100, 105–107, 285, 286, 289–297, 302, 305, 307, 309, 339, 346, 348, 349, 351–355, 360–366; 222/325, 129.1, 145, 185, 400.7; 134/99.2; 68/17 R; 138/45, 46; 220/669, 672, 771

[56] References Cited

U.S. PATENT DOCUMENTS

| | | | |
|---|---|---|---|
| D. 298,514 | 11/1988 | Dole et al. | D9/403 |
| 1,265,381 | 5/1918 | Ramey | 141/339 |
| 3,225,950 | 12/1965 | Josephsen et al. | 215/1 |
| 3,536,500 | 10/1970 | Cleereman et al. | 99/171 |
| 3,669,315 | 6/1972 | Kuckens | 222/148 |
| 4,113,129 | 9/1978 | Cambio, Jr. | 215/1 C |
| 4,125,334 | 11/1978 | Jones | 141/9 X |
| 4,328,909 | 5/1982 | Jeans | 222/54 |
| 4,344,459 | 8/1982 | Nelson | 138/45 |
| 4,408,701 | 11/1983 | Jeans | 222/399 |
| 4,421,804 | 12/1983 | Mori et al. | 428/35 |
| 4,457,343 | 7/1984 | Zukausky | 138/45 |
| 4,488,584 | 12/1984 | Hestehave et al. | 141/339 |
| 4,523,697 | 6/1985 | Jeans | 222/185 |
| 4,570,830 | 2/1986 | Jeans | 222/185 |
| 4,624,395 | 11/1986 | Baron et al. | 222/129.1 |
| 4,637,439 | 1/1987 | Jeans | 141/18 |
| 4,664,292 | 5/1987 | Jeans | 222/1 |
| 4,691,822 | 9/1987 | Malancon, Jr. | 206/229 |
| 4,805,793 | 2/1989 | Brandt et al. | 215/10 |
| 4,805,808 | 2/1989 | Larson | 222/185 |
| 4,865,211 | 9/1989 | Hollingsworth | 220/8 |
| 4,874,023 | 10/1989 | Ulm | 141/346 |
| 4,911,212 | 3/1990 | Burton | 141/18 X |
| 4,993,565 | 2/1991 | Ota et al. | 215/1 C |
| 5,042,698 | 8/1991 | Fessell | 141/294 X |
| 5,067,622 | 11/1991 | Garver et al. | 215/1 C |
| 5,123,554 | 6/1992 | Arvidson et al. | 215/12.2 |
| 5,141,121 | 8/1992 | Brown et al. | 215/100 A |
| 5,147,615 | 9/1992 | Bird et al. | 222/185 X |
| 5,222,615 | 6/1993 | Ota et al. | 215/1000 C |
| 5,224,614 | 7/1993 | Bono et al. | 220/771 X |

FOREIGN PATENT DOCUMENTS

| | | | |
|---|---|---|---|
| 0356829A1 | 3/1986 | European Pat. Off. | B65D 23/10 |
| 2373486 | 12/1977 | France | B67D 3/02 |
| 797340 | 3/1957 | United Kingdom . | |

OTHER PUBLICATIONS

SodaMate's Instruction Manual For The Care And Use Of Your Carbonated Beverage Dispenser; Model S100, Not Dated.

Hydro Systems Company's brochure on "Hydro Omni-Clean Streamline Series." Feb. 1990.

*Primary Examiner*—J. Casimer Jacyna

*Attorney, Agent, or Firm*—Gary L. Griswold; Walter N. Kirn; Leland D. Schultz

[57] ABSTRACT

A gravity based system for accurately dispensing a fluid and for mixing the fluid with another fluid. The system includes a bottle containing a quantity of the fluid. The bottle may be inverted and engaged with a dispenser assembly. The system is constructed so that the bottle is opened to allow the fluid to flow through the system when the bottle is engaged with the system, and to close the bottle when not engaged with the system. A second fluid may be introduced into the system and mixed with the first fluid in a controlled manner to dilute the first fluid.

40 Claims, 18 Drawing Sheets

GRAVITY FEED FLUID DISPENSING SYSTEM

FIELD OF THE INVENTION

This invention relates generally to systems for dispensing fluids, and more particularly to gravity feed fluid dispensing systems.

BACKGROUND OF THE INVENTION

Systems have been developed in the past for dispensing fluids in a controlled manner. Such systems have included positive displacement systems in which a fluid is suctioned from a container, such as by a pump. For instance, the "Compublend" brand cleaning chemical management system available from the Minnesota Mining and Manufacturing Company Co. of St. Paul, Minn. is an example of one such system. While having its own utility, positive displacement systems generally are expensive and complicated, and may not be desirable for relatively low volume applications.

Another approach is to utilize a venturi effect to suction a fluid from a container. This latter approach also is advantageous in that it is frequently desirable to mix or dilute the fluid with one or more other fluids prior to use. For instance, if the fluid to be dispensed is a cleaning chemical, disinfectant, herbicide or insecticide, it may be desirable to dilute the chemical prior to application with water or another fluid for safety, efficacy, or economical reasons. In such cases, water may be induced to flow past the fluid and the fluid placed in communication with the stream of water. As is known in the art, the velocity of the water creates a lower pressure in the stream that induces the fluid to be siphoned into the stream, simultaneously diluting the fluid. An example of a venturi effect fluid dispensing system is the Hydro Omni-Clean brand proportioning and dispensing system available from the Hydro Systems Company of Cincinnati, Ohio.

However, venturi effect fluid dispensing systems, while having their own utility, are undesirable for many situations in which high levels of accuracy and consistency are desired or required. Typically, conventional venturi affect systems provides an accuracy rate that widely varies from the desired rate. That is, over time, although average rates may be close to what is desired, fluctuations in the flow rate may widely exceed or fall below desired values.

Another type of fluid dispensing system is a gravity feed fluid dispensing system in which a bottle or like container containing a quantity of the fluid is inverted and the fluid allowed to flow downwardly from the bottle under the influence of gravity. An example of a gravity feed fluid dispensing system is the Model S100 brand carbonated beverage dispenser available from SodaMate Enterprises Inc. of Trumbull, Conn. The Model S100 dispenser includes an inverted bottle containing a beverage concentrate and a source of a pressurized carbonated water. The concentrate is mixed with the carbonated pressurized water as a dilutant and then dispensed into a suitable beverage container for consumption. Although the Model S100 dispenser operates effectively with such carbonated beverages, it is not designed for use with non-carbonated fluids. Further, the design requires the use of an external power source, such as compressed carbon dioxide gas. This increases the complexity and cost of the dispenser.

SUMMARY OF THE INVENTION

Disclosed is a system for dispensing a fluid, including a bottle having a cavity for receiving a quantity of the fluid and an orifice communicating between the cavity and exteriorly of the bottle. A valve is mounted on the bottle about the orifice for controlling flow of the fluid. The valve is shiftable between a first, closed position preventing flow of the fluid from the bottle, and a second, open position for dispensing the fluid from the bottle through the orifice at a predetermined rate.

A dispenser assembly is included for supporting the bottle while dispensing the fluid. The dispenser includes a body having a fluid chamber, a receiving opening and a dispensing opening below the receiving opening, each communicating with the fluid chamber. Supporting means are provided for engaging and supporting the bottle on the body with the orifice of the bottle directed downwardly through the receiving opening, wherein when the valve is in the open position the fluid is dispensed from the bottle and outwardly from the dispenser assembly through the dispensing opening. Means are provided for shifting the valve on the bottle from the closed position to the open position to enable dispensing of the fluid, the shifting means being actuated when the bottle is engaged with the supporting means.

Means are provided adapted for connection to a source of a diluting fluid and for conveying the diluting fluid to the diluting chamber. A diluting valve is provided for controlling the flow of the diluting fluid into the fluid chamber. The diluting valve is shiftable between an open position enabling flow of the diluting fluid into the fluid chamber, and a closed position preventing flow of the fluid into the dilution chamber, with the diluting valve being biased to the closed position. Switch means are provided for shifting the diluting valve to the open position responsive to the bottle being received by and engaged with the supporting means of the dispenser body, to enable the diluting fluid to flow into the diluting chamber, whereby the fluid from the bottle and the diluting fluid will intermix in the diluting chamber and flow outwardly of the dispenser assembly though the dispensing opening.

The present invention further includes a dispenser assembly as described herein for use with a bottle containing a quantity of a fluid to be dispensed, with a valve cap for controlling the flow of the fluid from the bottle.

BRIEF DESCRIPTION OF THE DRAWINGS

The present invention will be further described with reference to the accompanying drawing wherein like reference numerals refer to like parts in the several views, and wherein.

DETAILED DESCRIPTION OF THE INVENTION

Figure 1A:
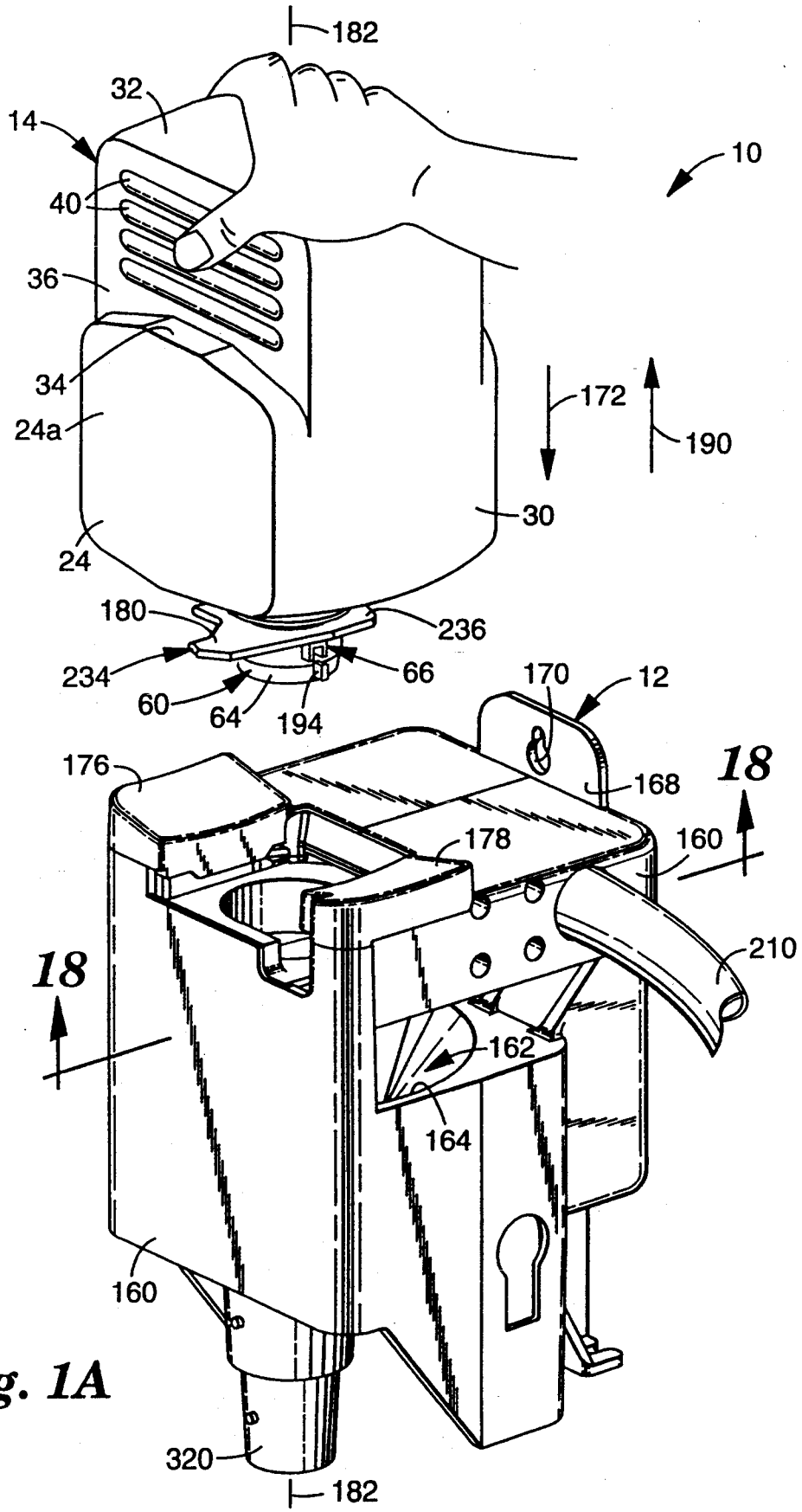
FIG. 1A is an isometric view of a gravity feed dispensing system according to the present invention with an inverted bottle with a valve cap positioned for engagement with the dispenser assembly.

Referring now to FIG. 1A, there is shown a fluid dispensing system 10 according to the present invention. The dispensing system includes a dispenser assembly 12 and a bottle 14 containing a quantity of a fluid that is to be dispensed. Typically, the fluid is provided in a concentrated form (the "concentrate") with the intention that the concentrate will be diluted with at least one other diluting fluid (the "dilutant") prior to being dispensed and used. The concentrate may be any one of a wide variety of material, such as cleaning fluids, solvents, disinfectants, insecticides, herbicides, or the like. The dilutant may be water or any other suitable fluid.

Although the dispensing system of the present invention might employ any suitable bottle or other container for the concentrate, in the preferred embodiment of the invention, the bottle 14 is constructed according to co-pending United States patent application Ser. No. 08/049,844 "Bottle for Containing a Fluid ", filed of even date herewith and commonly assigned to the assignee of the present invention, the contents of which are incorporated herein by reference.

More specifically, there is shown in FIGS. 2–5, a bottle 14 according to the present invention. The bottle 14 includes an orifice 16 in neck 18 on an upper side 20 communicating interiorly of the bottle for passage of fluid between the interior cavity 22 of the bottle and exteriorly of the bottle. Although the bottle may be constructed with any suitable configuration, such as cylindrical, in the illustrated embodiment of the invention, the bottle is generally rectangular in shape, including first and second sides 24, 26 and ends 28,30, as well as bottom 32.

Means may be provided as part of the bottle of this invention to resist "paneling". Paneling occurs with the bottle inverted and as the fluid level is reduced. A partial vacuum is created in the "headspace" above the level of the liquid within the bottle. The walls of the bottle are gradually deflected inwardly under the influence of the partial vacuum. This deflection acts to enable the flow of the fluid from the bottle. The deflection increases until a point is reached where a quantity of the liquid has been dispensed from the bottle and the walls quickly flex outwardly, whereby the pressure in the head space is equalized with the ambient pressure. The fluctuation of the flow of fluid from the bottle due to paneling prevents accurate metering of the dispensing of the fluid or dilution of the fluid By "resist" it is meant that paneling is reduced or eliminated when the bottle is inverted and the fluid is being dispensed.

In the illustrated embodiment to the invention, the paneling control means includes shoulder 34 separating upper portions 24*a*,26*a* of the first and second sides 24,26 from a pair of parallel, laterally spaced gripping surfaces 36,38. The shoulder 34, or any like sharp change in the shape or geometric configuration of the bottle acts to strengthen the sides of the bottle to resist paneling. As can be seen from FIGS. 1A,1B and 2, the shoulder need not be entirely linear (e.g. the middle portion is transverse, but opposite end portions are inclined upwardly), but extends in a generally transverse manner across the first and second sides between the gripping surfaces 36,38 and the orifice 16 of the bottle.

The degree of paneling resistance required is determined by the construction (including, but not limited to, material, wall thickness, capacity) of the bottle. Thus, the wall thickness, weight and expense of the bottle of the present invention may be reduced from what it might otherwise have to be in order to resist paneling. Conventional bottles for dispensing systems must either reduce the size and capacity of the bottle, or increase the wall thickness, and consequently the weight and expense of the bottle to avoid paneling, and even then may be not be completely successful in providing effective resistance to paneling.

Gripping surfaces 36,38 are adapted for manual engagement and manipulation of the bottle. As shown particularly in FIGS. 1A,1B and 2, the gripping surfaces 36,38 facilitate the manual grasping and manipulation of the bottle 14. Most conveniently, the gripping surfaces 36,38 include a plurality of parallel, transverse ribs 40. The ribs 40 are sized, constructed and located in a manner to most advantageously enhance the ability to manually grasp the bottle to perform the inversion and installation of the bottle with respect to a dispensing system. Alternatively, the surface of the gripping surfaces 36,38 may be otherwise adapted to enhance the grasping of the bottle, such as by knurling or roughening of the surface.

It will be understood that the ribs 40 may also be constructed in a manner that assists shoulder 34 in resisting paneling in the gripping surfaces 36,38, and thus form part of the means to resist paneling. Such resistance to paneling would be exhibited if, for instance, the ribs were formed on the inner side of the gripping surfaces (e.g. within cavity 22) and other means were provided on the exterior surface of the gripping surface to enhance manual engagement and manipulation of the bottle, as previously described herein. The means for resisting paneling, which most preferably includes ribs 40, thus acts to resist the paneling that occurs when the bottle is squeezed while being manually grasped, such as to invert the bottle or to engage the bottle with the dispensing system of the present invention.

The bottle 12 of the present invention may be constructed in any suitable manner and of any suitable material, but is most advantageously constructed of a polymeric material, such as high density polyethylene, low density polyethylene, polyethylene, polyvinyl chloride, polystyrene or the like. It will be recognized that the material selected to construct the bottle must be compatible with the fluid to the bottle is to receive and dispense. Preferably, the bottle is a unitary molded body, formed by any suitable process, such as by blow molding, injection molding, or injection/blow molding, as are known in the art.

Valve means are provided to control the dispensing of the fluid from the bottle. In the illustrated embodiment, the valve means takes the form of valve cap 60. Valve cap 60 may be of any suitable design, but is preferably as disclosed in U.S. Pat. No. 4,570,830, entitled "Gravity Dispenser".

Figure 6:
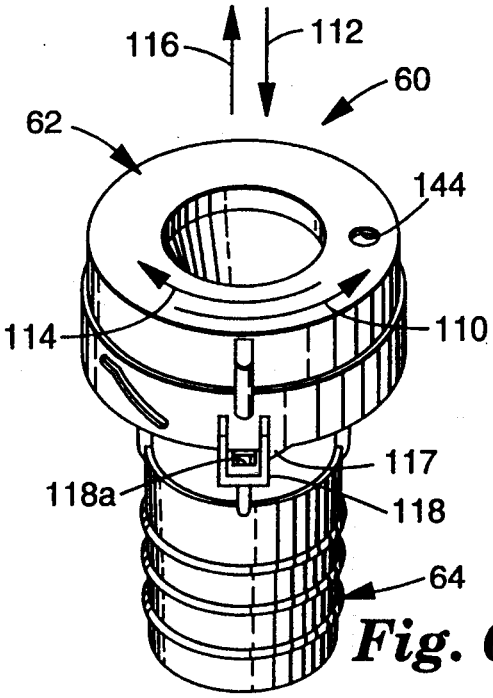
FIG. 6 is an isometric view of the valve cap of FIGS. 1A and 2.

As shown in FIG. 6, valve cap 60 includes cooperative cap 62 and insert 64. Conveniently, both the cap and insert are unitary molded members, constructed of a polymeric material, such as high density polyethylene. Preferably, the material is selected so as to be compatible with the fluid to be dispensed from the bottle and through the valve cap.

Figure 10A:
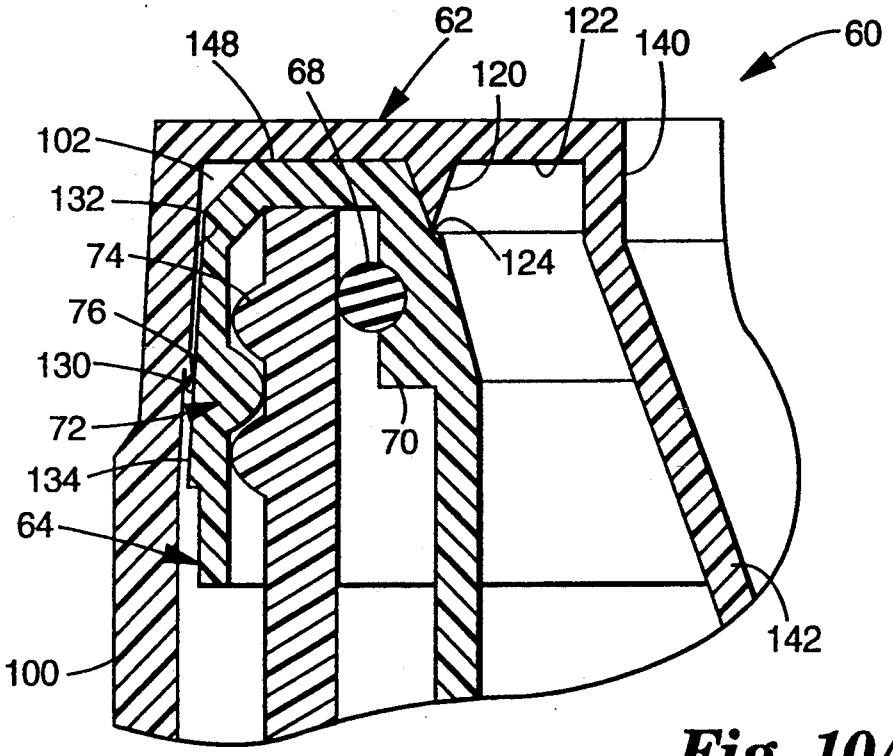
FIG. 10A is a partial magnified cross sectional view of a portion of the valve cap of FIG. 10.
Figure 3:
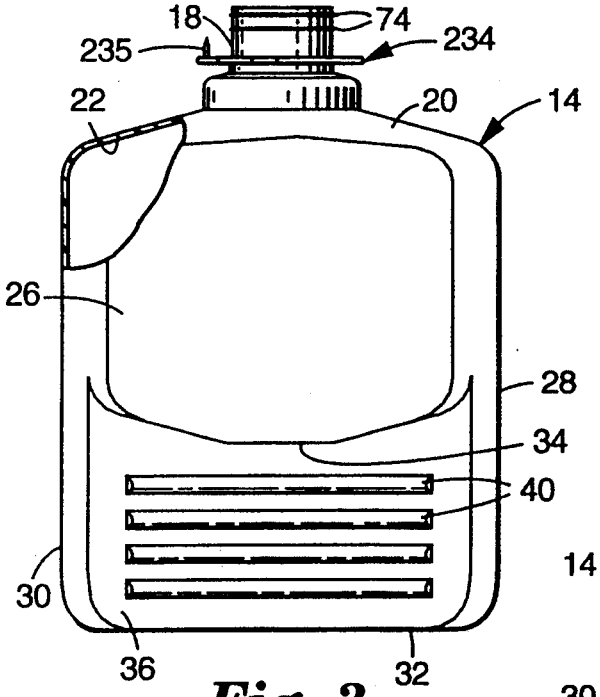
FIG. 3 is a front view of the bottle of FIG. 2 without a valve cap, in an upright position.
Figure 4:
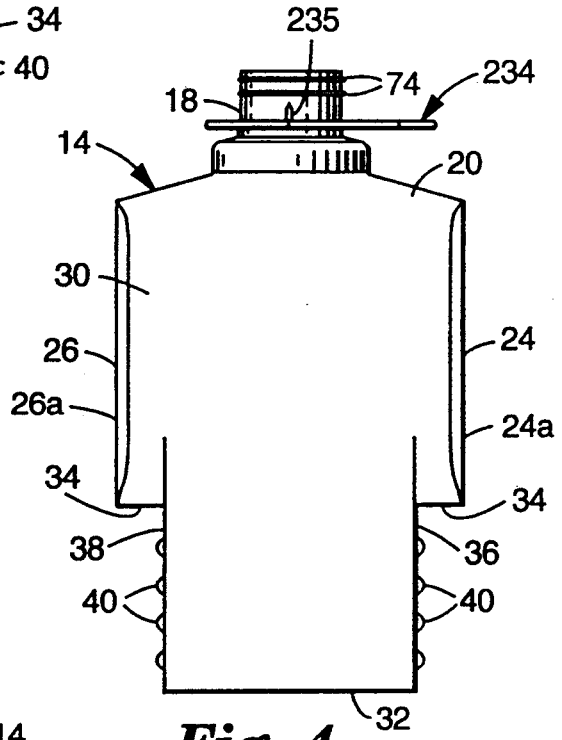
FIG. 4 is a side view of the bottle of FIG. 2.
Figure 5:
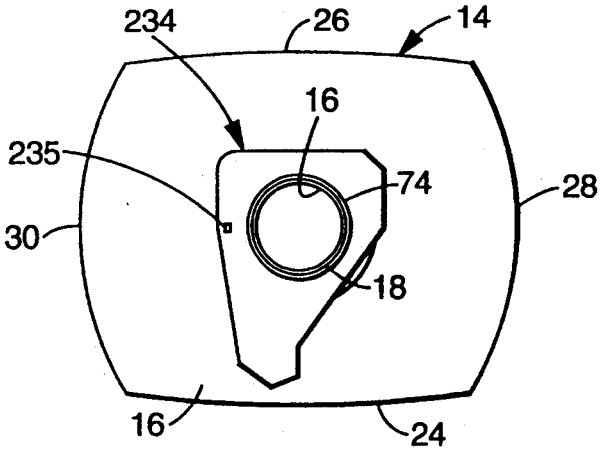
FIG. 5 is a top view of the bottle of FIG. 2.

When the valve cap 60 is mounted on the bottle (as in FIGS. 10 and 11), insert 64 extends into the bottle 14 through orifice 20 into cavity 22 of the bottle. The insert 64 has a cylindrical portion 66 which, in effect, forms an extension of the neck 16 of the bottle. 0-ring 68 is mounted on annular flange 70 on the exterior of the cylindrical portion 66 to seal against the interior of neck 16 when the valve cap is mounted on the bottle. The insert (and thus the valve cap) is secured to the bottle by snap closure 72 (shown more particularly in FIG. 10A) that includes a pair of annular protuberances 74 on the bottle neck and annular lip 76 on the cylindrical portion 66 that is interposed between and retained by the protuberances. Alternatively, the insert could be sealingly secured to the bottle by cooperative threads (not shown) on the neck of the bottle and the insert, or any other suitable arrangement.

Figure 7:
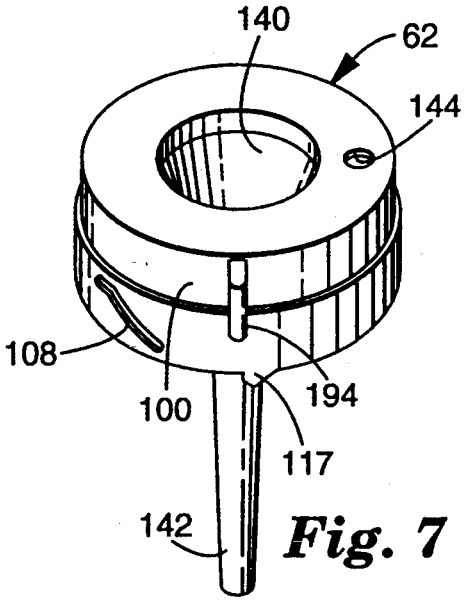
FIG. 7 is an isometric view of the cap portion of the valve cap of FIG. 6.
Figure 9A:
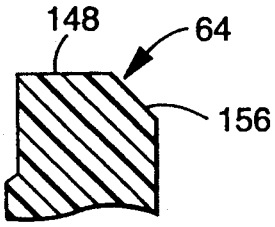
FIG. 9A is a magnified partial cross sectional view of the insert of FIG. 9 showing a chamfered edge.
Figure 9B:
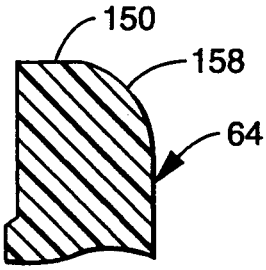
FIG. 9B is a magnified partial cross sectional view of the insert of FIG. 9 showing the wiper member.
Figure 7A:
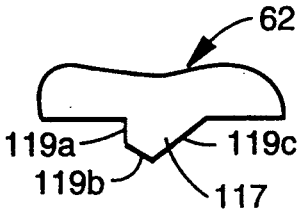
FIG. 7A is a magnified partial view of a tab projecting from the cap portion of FIG. 7.
Figure 8:
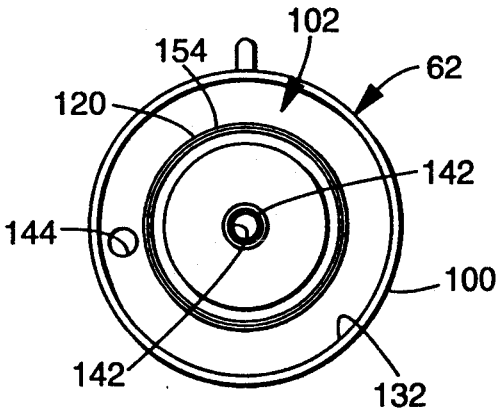
FIG. 8 is bottom view of the cap of FIG. 7.
Figure 9:
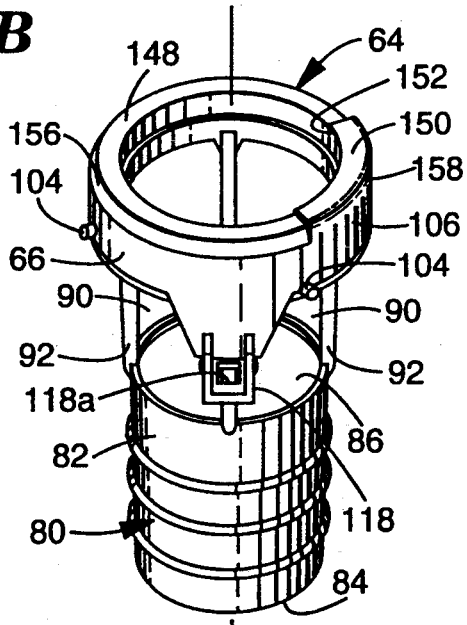
FIG. 9 is an isometric view of the insert portion of the valve cap of FIG. 6.

Referring now also to FIGS. 7–9, housing 80 is provided that includes a generally cylindrical side wall 82, a bottom 84, and a chamber top 86 to enclose and form chamber 88. Top 86 insures that the chamber 88 cannot be filled with liquid to prevent operation no matter how the bottle is turned. Chamber 88 is an air chamber for venting to atmosphere, thereby maintaining a constant head pressure (e.g. a slight vacuum with respect to ambient air pressure) during the dispensing of the fluid, as is described in the '830 patent. Ports 90 are formed in the side wall 84 of the housing 80. In the illustrated embodiment, there are four ports 90. Preferably, the ports 90 take up most of the circumference of the side wall 82 so that, in effect, the side wall is supported by four legs 92.

Cap 62 includes annular skirt 100 forming annular recess 102 into which the cylindrical portion 66 of the insert is received, so that the cap is rotatively mounted on the insert. Relative rotation of the cap 62 with respect to the insert 64 will be converted into relative axial movement of the cap with respect to the insert between a first spaced, open position (as in FIG. 11) and a second, closed position with the cap is sealing contact with the insert (as in FIG. 10).

This relative movement is accomplished using a valve cap camming arrangement as shown, or any other suitable arrangement known in the art. In the illustrated embodiment, the valve cap camming arrangement includes one or more radially projecting pins 104 extending from exterior surface 106 of the cylindrical portion 66 of the insert. A like number of aligned camming slots 108 are formed in the facing skirt 100 of the cap. Each camming slot 108 is constructed with a corresponding profile and extends from a first, upper position (as in FIG. 10) in which the cap 62 and insert 64 are sealed against each other in a manner described in greater detail herein, to close the valve cap, and a second, lower position (as in FIG. 11) in which the cap and the insert are axially spaced from each other to open the valve cap and enable the flow of fluid therethrough as hereinafter described.

As the cap 62 is rotated in direction 110 relative to insert 64, the radially extending pins 104 engaged with the camming slots 108 induce relative axial movement in direction 112 of the cap and the insert to the closed position; whereas relative rotational movement of the cap in direction 114 will induce relative axial movement between the cap and the insert in opposite direction 116 to the open position.

Means may be provided to prevent accidental shifting of the valve cap from the closed position to the open position, thereby avoiding unintended spillage of the fluid within the bottle. In the illustrated embodiment, the shifting prevention means includes tab 117 projecting from skirt 102 of the cap. The tab 117 engages tab 118 on the insert to interfere with relative rotation of the cap with respect to the insert in direction 110. The tab 117 includes a first surface 119*a*, a second, inclined surface 119*b*, and a third, inclined surface 119*c*. If it is desired to rotate the cap with respect to the insert as herein described, the cap and insert must be slightly axially offset to disengage the tab 118 from surface 119*a* of the tab 117. Relative rotation of the cap with respect to the insert in direction 110 may be accomplished by sliding engagement with surface 119*b* and 119*c*, to the fully open position. During relative rotation of the cap and insert in direction 114, inclined surface 119*c* will be encountered by tab 118 and sliding movement will rotate the tab 118 past surface 119*c*, then 119*b* and back into the fully closed position adjacent surface 119*a*. Of course other suitable arrangements may be provided for securing the valve cap against unintended shifting from the fully closed position.

Means may also be provided to prevent relative rotation of the insert 64 and the bottle 14. In the illustrated embodiment, this means includes aperture 118*a* formed in tab 118 may be engaged with a suitable finger 235 projecting from camming flange 234.

Figure 10:
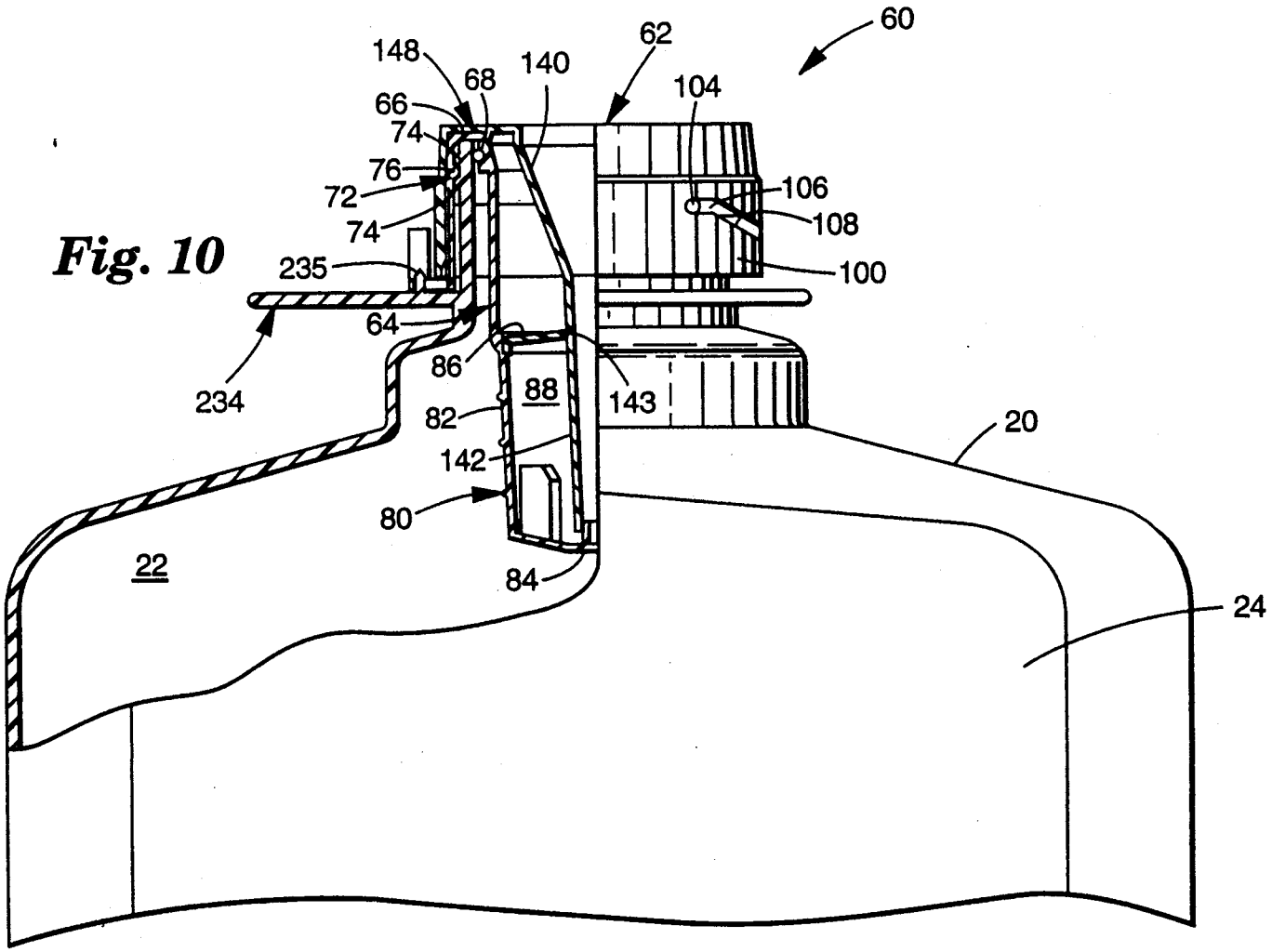
FIG. 10 is a partial front view, partially broken away, of the valve of FIG. 6 mounted on a bottle and in a closed position.
Figure 11:
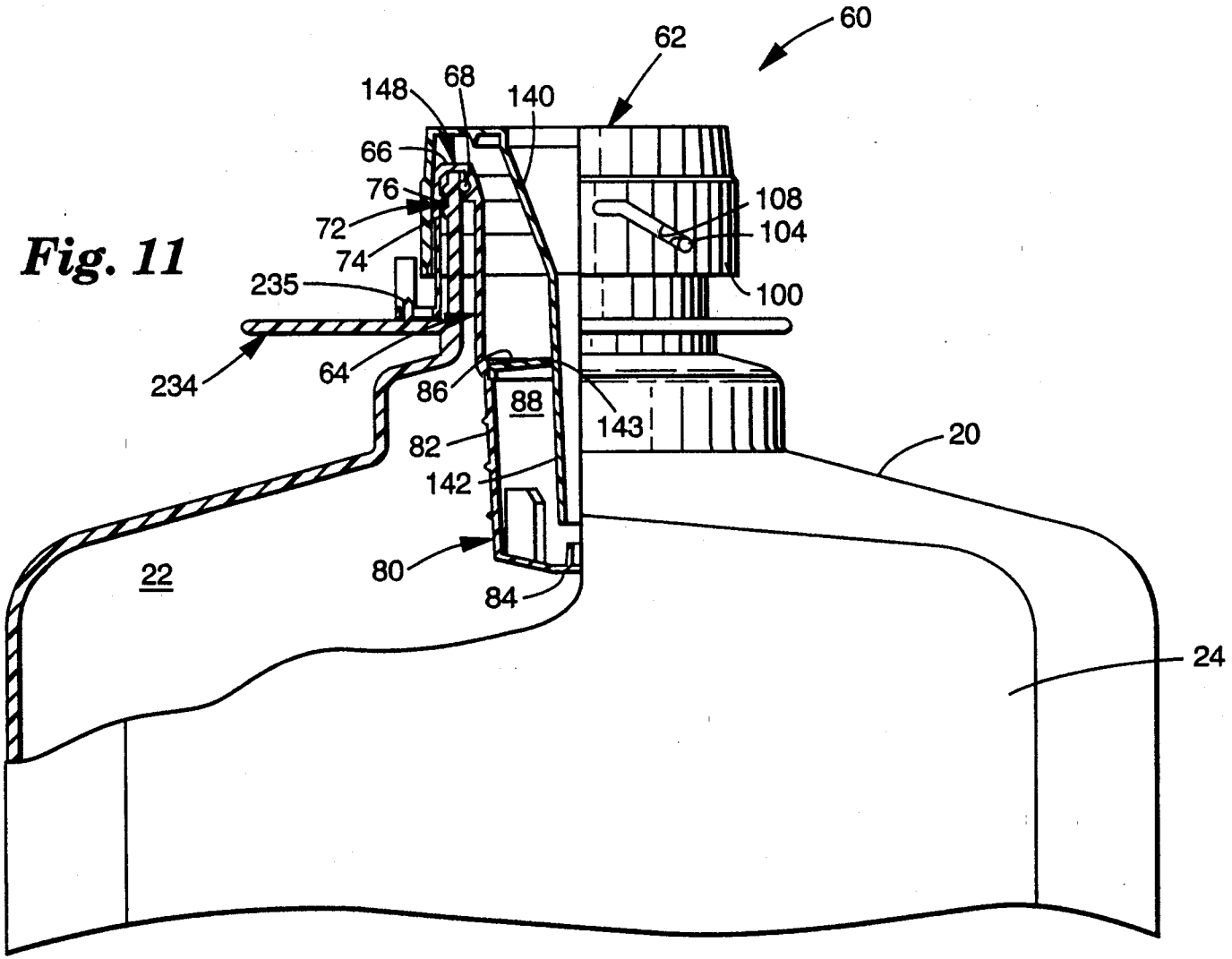
FIG. 11 is partial front view, partially broken away, of the valve cap of FIG. 10 in an open position.

Means are provided to seal the cap against the insert when the valve cap is shifted to its closed position, as in FIG. 10. Any suitable valve sealing means known in the art may be employed. In the illustrated embodiment of the invention, dual valve sealing mechanisms are incorporated into the cap and insert, shown more particularly in FIG. 10A. The first valve sealing mechanism includes annular ring 120 extending from interior surface 122 of the cap. Annular seat 124 is formed in the insert and sealingly contacts the annular ring 120 when the insert and cap are brought together.

The other valve sealing mechanism in the illustrated embodiment includes resilient annular lip 130, preferably integrally formed on surface 132 of the cap, when cap 62 is formed. As the cap and insert are brought together, the lip 130 encounters the exterior surface 134 of the cylindrical portion 66 of the insert and is compressed radially outward. The lip is thus resiliently urged into sealing contact with the insert when the valve cap is in its closed position.

The cap 62 includes central bore 140. A tube 142 extends from the bore 106 of the cap through aperture 143 in the chamber top 86, so that the distal end of the tube is located within the chamber 88 in both open and closed positions for the valve cap. The tube 142 may be molded integrally with cap 62 or may be a separate tubular member sealed to the cap. No matter which way the bottle is oriented, when the bottle is put back in the upright position, there is a sufficient volume of air remaining within the chamber 88 to insure that the top of tube 142 is not immersed in fluid.

A spout opening 144 is formed in the cap as shown, radially offset from the central axis 146 of the cap, insert and valve cap. The spout opening 144 is the terminus of the flow passage for fluid from the bottle when the bottle is inverted. The flow passage starts at ports 90, extends through the space 148 (as in FIG. 11) between the cap and insert when the valve cap is in the open position, and the through the spout opening. Spout opening 144 is sized to meter the flow depending on the viscosity of the particular fluid to be dispensed, and ambient temperature conditions.

After use, it has been found that an amount of residual fluid may be trapped (on surface 148, and as in FIG. 11) between the cap and the insert when the bottle is turned upright with the valve cap in an open position. It has been observed that for some fluids under some circumstances, such residual fluid may be forcefully ejected through spout opening 144 when the valve cap is shifted to the closed position and the cap and insert are brought together in sealing contact. This forceful ejection of the fluid is undesirable and may be dangerous, depending on the nature of the fluid. Thus, it would be preferable to return any residual fluid to the interior of the bottle for safety reasons, as well as for environmental and cost concerns.

This problem is attenuated in the preferred embodiment of the invention by reducing the height of annular ring 120 in the cap, so as to minimize the amount of residual fluid that may be encountered as the valve cap is being closed. However, this does not entirely eliminate the forceful ejection of the residual fluid during use of the valve cap.

Therefore, in the present invention, means are provided to prevent or attenuate the ejection of the residual fluid through spout opening 144 and to divert the residual fluid back into the cavity 22 of the bottle. In the illustrated embodiment, the fluid diverting means includes an arcuate wiper member 150 that projects from surface 148 of the insert 64. The inner radial edge 152 of the wiper member 150 is placed in sliding engagement with or slightly radially spaced from the outer radial edge 154 of the annular ridge of the cap. Preferably, the wiper member 150 is located and extends for a sufficient portion of the circumference of the insert so as to underlay the spout opening 144 throughout the shifting of the valve cap between the open and closed positions. In the illustrated embodiment, the wiper member occupies approximately 90° of the circumference.

The wiper member 150 and the annular ring 120 cooperatively "wipe" or divert the fluid inwardly and back thus back into cavity of the bottle through ports 90, rather through being ejected though spout opening 144. This is of necessity accomplished prior to the lower edge of the annular ring passing the upper edge of the wiper member, after which access to the flow passage of the fluid back to the cavity 22 of the bottle is obstructed. In the preferred embodiment of the invention, the major portion of the outer circumferential edge of the insert is chamfered at approximately a 45° angle (as at 156 in FIG. 9A). However, it has been observed that this chamfered edge acts to exacerbate the forceful ejection of the residual fluid through the spout opening. Therefore, the circumferential edge of the insert adjacent the wiper member is preferably formed on a radius (as at 158 in FIG. 9B) which as been found to assist in attenuating the ejection problem. Not withstanding the wiper member 150, it has been observed that a small amount of the residual fluid may be found to emerge through the spout opening 144 as the valve cap is being closed, but the amount and velocity of such fluid as may still be forcefully ejected is minimized as compared to prior art valve caps. Thus, the valve cap of the present invention may be used in an inverted position, then the bottle turned upright and the valve cap rotated to a closed position, while minimizing or eliminating the risk of encountering the ejected fluid.

The bottle 14 and valve cap 60 having been described, the dispenser assembly 12 is now referred to again in FIGS. 1A and B, 12, and 12A. Dispenser assembly 12 includes body 160, which may be constructed of one or more portions, as desired. Preferably, the body 160 includes one or more unitary molded members, constructed of polymeric material, such as polyphenolyn oxide, particularly Noryl 731 brand material available from General Electric Plastics or the like, assembled in any suitable manner. The body 160 includes a fluid chamber 162 extending between an upper receiving opening 164 and a lower dispensing opening 166, below the receiving opening. Both the receiving opening 164 and the dispensing opening 166 communicate with the fluid chamber 162. Flange 168 extends upwardly and includes aperture 170 for mounting the dispenser assembly to a vertical surface (not shown) such by a screw (not shown) or like mechanical fastener. It will be understood that other suitable means (not shown) may be employed to support the dispenser assembly.

Figure 1B:
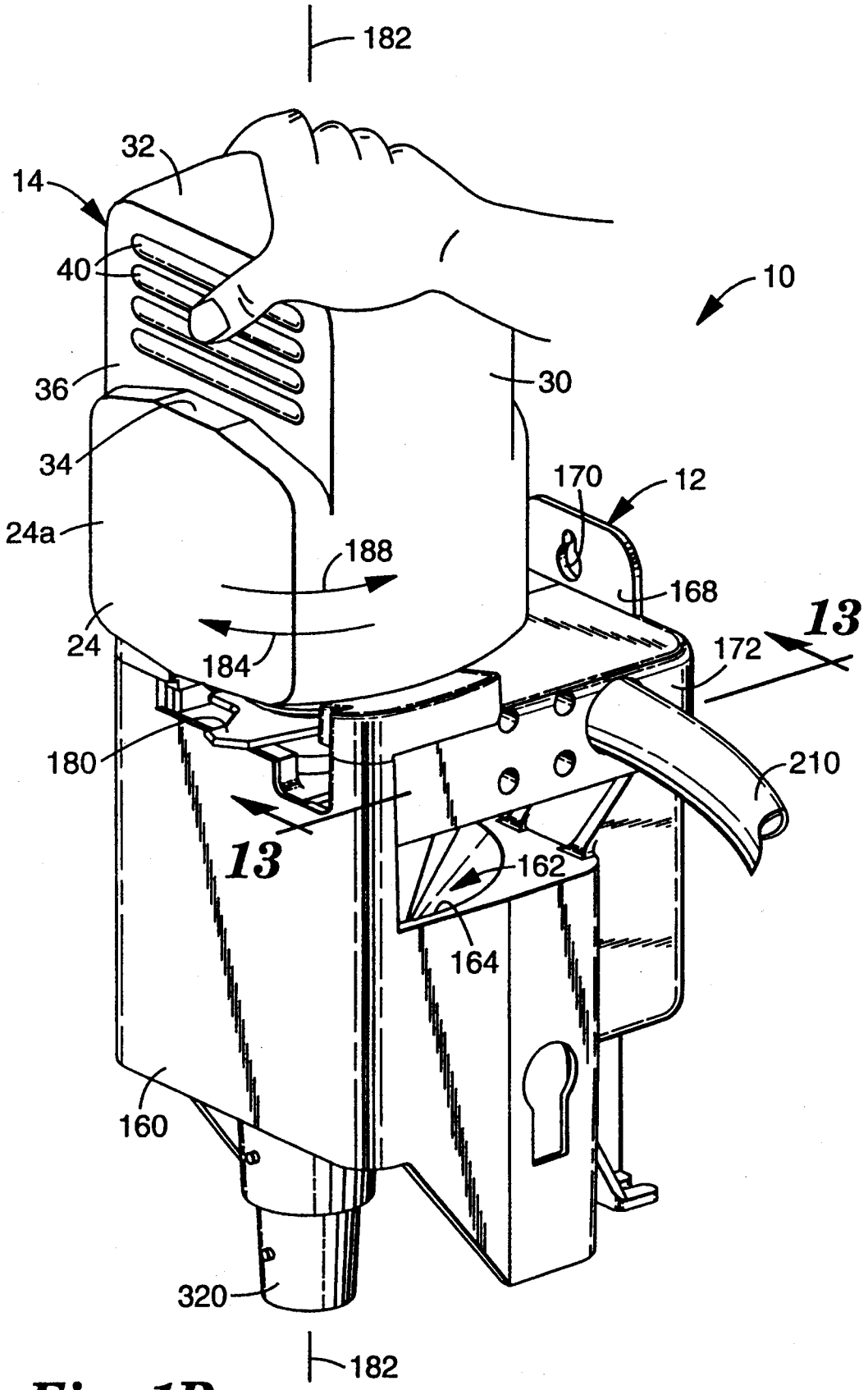
FIG.1B is the gravity feed dispensing system of FIG. 1B with the bottle inserted into, but not engaged with, the dispenser assembly.
Figure 2:
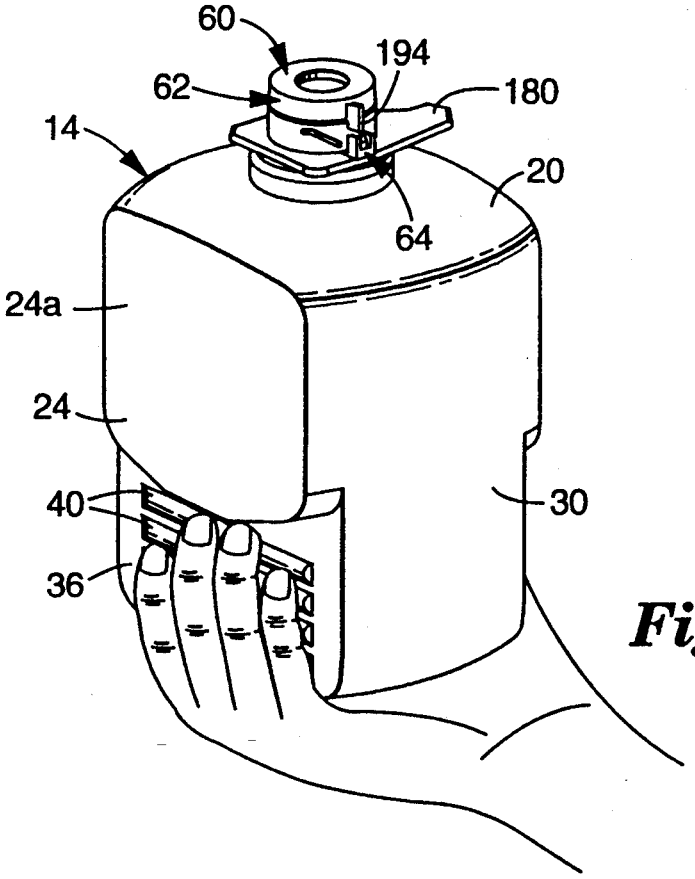
FIG. 2 is an isometric view of the bottle shown in FIG. 1 in an upright position and with a valve cap.

A bottle 14 may be inverted (as shown in FIG. 1A), and then inserted into the dispenser assembly 12 in direction 172 towards receiving opening 164 and fluid chamber 162 (as shown in FIG. 1B). Means are provided to support and secure the bottle 14 in an inverted position with orifice 16 of the bottle directed through receiving opening 164 towards fluid chamber 162. In the illustrated embodiment, the supporting means includes, in part, guide surfaces 176 and 178 adapted to conform to the exterior profile of the top side 20 of bottle 14. A visual guide member 180 radially projects from the neck of the bottle to facilitate the insertion of the bottle into the dispenser assembly in a first rotational position (shown in FIG. 1A) in regard to axis 182. The visual guide member 180 also forms a part of the supporting means in that the bottle and visual guide member may then be rotated in direction 184 to a second rotational position, thereby placing the visual guide member under ridge 186 formed in the dispenser body (as shown in FIG. 12A). The contact between the visual guide member 180 and the ridge 186, in conjunction with the guide surfaces 176,178 acts to support and secure the bottle in engagement with the dispenser assembly. The bottle may be disengaged from the dispenser assembly by rotating the bottle in opposite rotational direction 188, disengaging the visual guide member 180 from ridge 186, and returning the bottle to the first rotational position. The bottle may then be removed from the dispenser assembly in opposite direction 190.

Means are provided to shift valve cap 60 from its first, closed position maintained during the process of inserting the bottle in direction 172 into the dispenser assembly, to prevent spillage of the fluid, to the second, open position when inverted and secured to the dispenser assembly (as described herein), to enable fluid to flow through the valve cap and from the bottle into the fluid chamber 162 of the dispenser assembly 12. Preferably, the valve cap 60 is automatically shifted during the process of inserting the inverted bottle 14 into the dispenser assembly and rotating it to the second rotational position.

Figure 12:
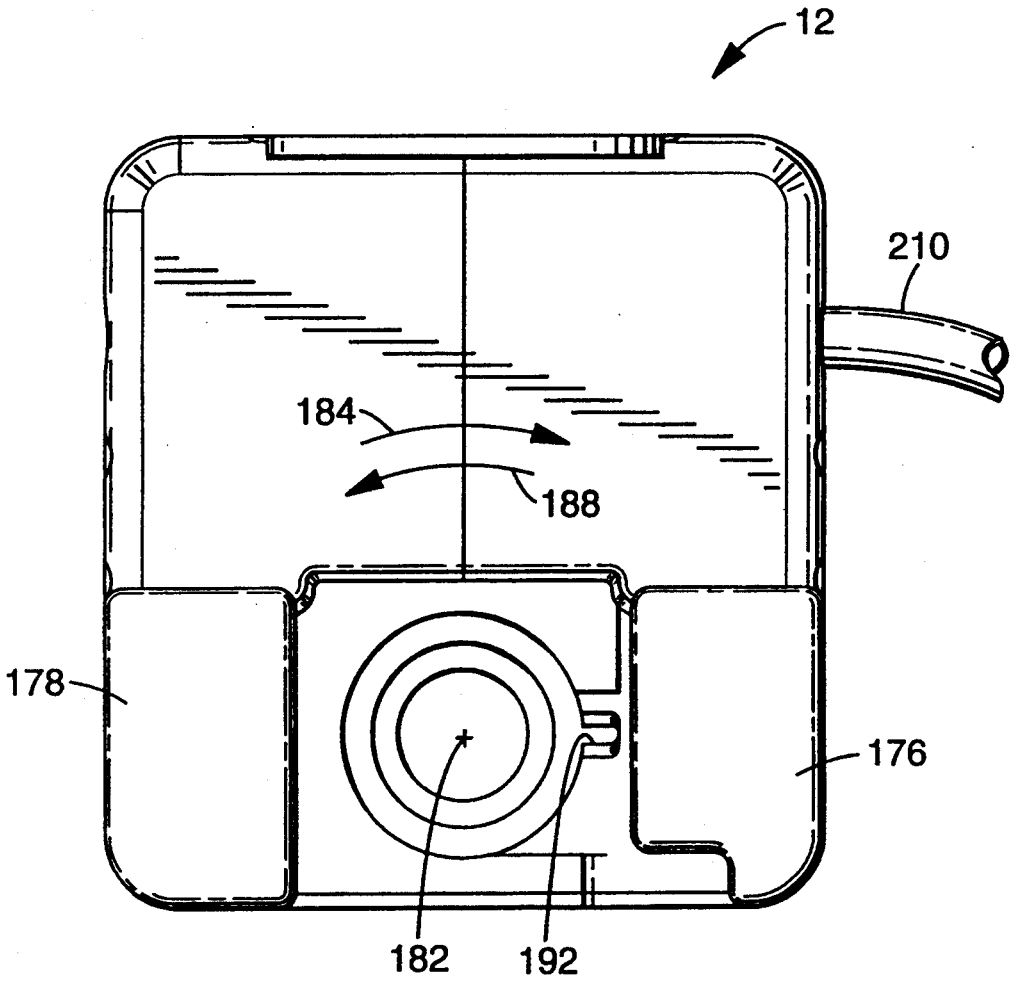
FIG. 12 is a top view of the dispenser assembly of FIG. 1.
Figure 12A:
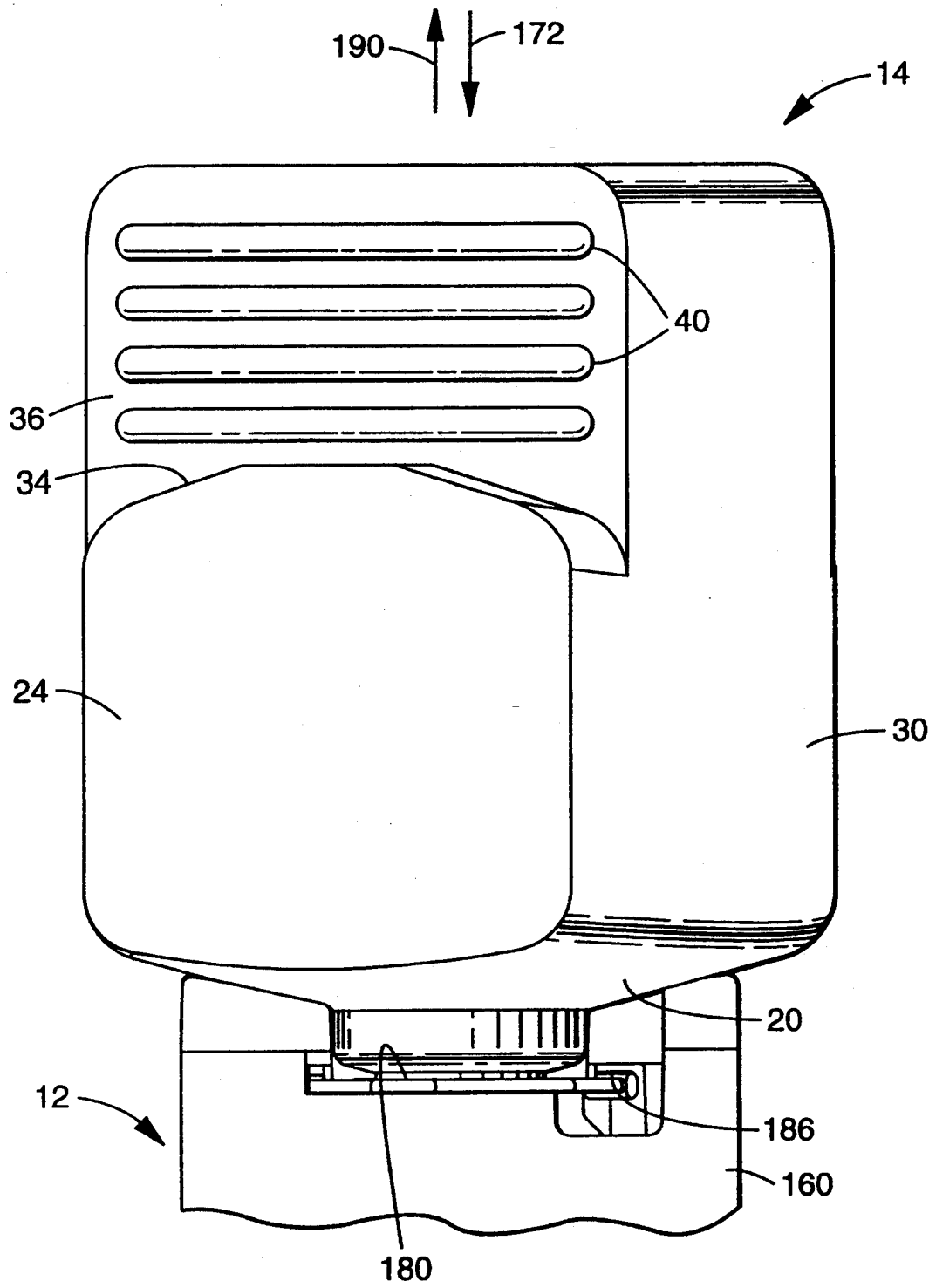
FIG. 12A is a partial front view of the dispenser assembly of FIG. 12 with a bottle inserted and engaged with the dispenser assembly.
Figure 13:
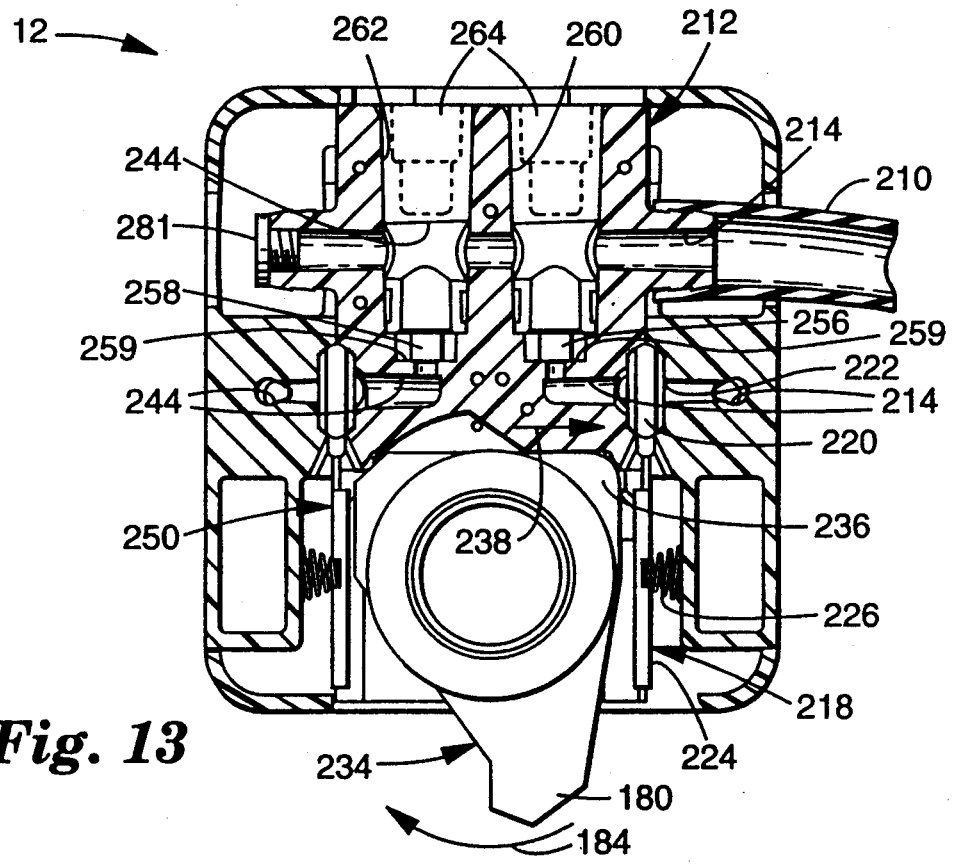
FIG. 13 is cross-sectional view along plane 13—13 of FIG. 1B of the Dispenser assembly with a bottle inserted into the dispenser assembly, but not rotated into engagement.

In the illustrated embodiment, and as shown more particularly in FIGS. 12 and 12A, the shifting means includes radial keyway 192 extending outwardly from the receiving opening. Cap 62 of the valve cap 60 includes cooperative radially projecting key 194. When the bottle 14 is inverted and vertically inserted in direction 172 into the dispenser assembly, it must assume the first rotational position, as shown in FIGS. 1B and 13, in order for the key 194 of the cap 64 to be received within aligned radial keyway 192. The bottle must then be rotated in rotational direction 188 to the second rotational position, wherein the bottle is secured by the supporting means in the manner herein described. The rotation of the bottle likewise rotates the insert 64 portion of the valve with the bottle, while cap 62 is maintained stationary by engagement between key 194 and keyway 192. The relative rotation of the cap with respect to the insert opens valve 60 to enable the fluid within the bottle to be dispensed, in conjunction with the camming arrangement as described herein.

When the bottle 14 is to be removed, the bottle is rotated in opposite rotational direction 188 back to the first position shown in FIG. 1B, where the bottle may be removed from the dispenser assembly in axial direction 190. In a similar fashion, insert 64 is likewise rotated in rotational direction 188 while cap 62 is held stationary by engagement between key 194 and keyway 192. This shifts the valve cap back to a closed position, so that the bottle may be removed from the dispenser assembly in direction 190 without spillage of the fluid.

As previously described, it is desirable to convey a second fluid, or dilutant, to the fluid chamber for mixing with the concentrate 16 as it is being dispensed from the bottle. Means are provided for conveying a dilutant to the chamber 162 of the dispenser assembly 12. In the illustrated embodiment shown particularly in FIG. 13, the conveying means includes inlet hose 210 connected at one end to source of the dilutant (not shown) and at the other end to manifold 212 mounted on the dispenser assembly 12. Manifold 212 is in fluid communication with chamber 162 through first conduit 214. In the illustrated embodiment, the first conduit 214 extends generally horizontally and then downwardly to first nozzle 216, shown more particularly in FIG. 18. First diluting valve 218 enables flow of the dilutant through the manifold 212, through first conduit 214 into fluid chamber 162 when in an open position, and blocks flow therethrough when in a closed position.

Figure 13A:
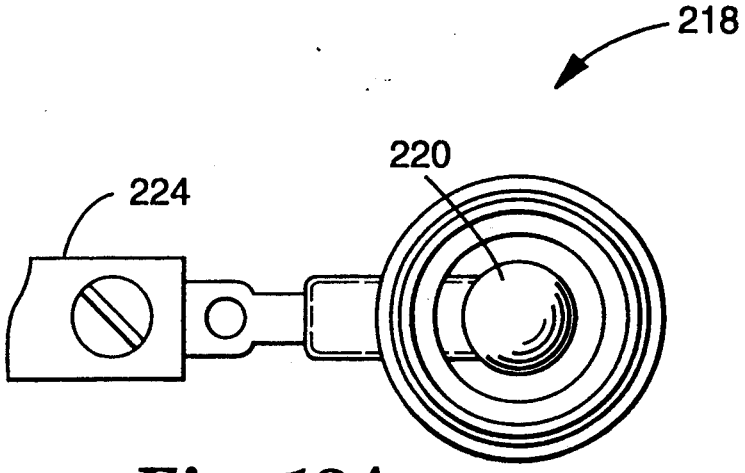
FIG. 13A is a partial magnified view of a portion of the first diluting valve of FIG. 13.

First diluting valve 218, also shown in FIG. 13A, may be of any suitable type, but in the preferred embodiment of the invention, is a "banjo" type valve that includes valve member 220 constructed of a resilient material, such as rubber, adapted to seal against a cooperative valve seat 222 formed in the first conduit. The valve member 220 is mounted on one end of arm 224, pivotally mounted on the dispenser assembly and biased by spring 226, and by the pressure of the dilutant in the first conduit 214, in direction 228 to a first, closed position, as shown. When opened, first diluting valve 218 enables flow of the dilutant through first conduit 214 into the fluid chamber 162 to mix with the flow of the concentrate as elsewhereherein described.

First diluting valve 218 could be manually opened when it is desired to convey the fluid to the dilution chamber. However, in the preferred embodiment, means are provided to automatically open the diluting valve 214 when the bottle 14 is engaged with the support means of the dispenser assembly. In the illustrated embodiment of the invention, the means for automatically opening the first diluting valve includes camming means. The camming means includes camming flange 234 radially projecting from the bottle 14 about neck 18. Camming flange 234 includes a first camming lobe 236. Preferably, the camming flange and first camming lobe are integrally formed (e.g. molded) with the bottle. Alteratively, the camming flange may be a separately formed planar member (not shown) with an aperture through which the neck of the bottle is inserted and the camming flange retained by the valve cap 60 when secured to the bottle.

Figure 14:
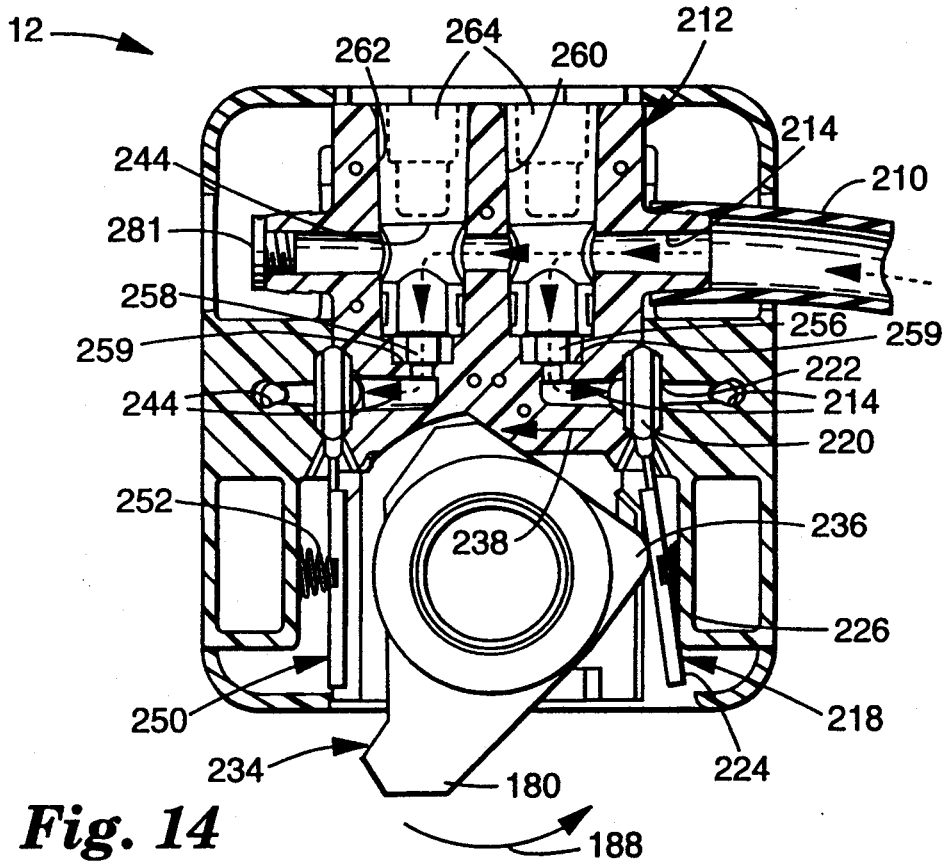
FIG. 14 is a cross sectional view of the dispenser assembly of FIG. 13, with the bottle rotated to engage the dispenser assembly.

Camming flange 234 is so constructed and situated so that when the bottle 14 is inverted and inserted into the dispenser assembly, it assume the first rotational position, as shown in FIGS. 1A and 13, as previously discussed with respect to the visual guide member 180, with the camming flange 234 and diluting valve 218 angularly spaced apart, but axially aligned as in FIG. 13. The bottle 14 must then be rotated in rotational direction 188 to the second rotational position. As shown in FIG. 14, the rotation of the bottle likewise rotates the camming flange 234 so that the first camming lobe 236 contacts and pivots first diluting valve 218 in direction 238, so that the valve member 220 is displaced from valve seat 222 to an open position against the force of spring 226 and the pressure of the first dilutant. This enables the flow of the dilutant from inlet hose 210 into the fluid chamber 162 as shown.

The flow of the dilutant will continue until the bottle is rotated in opposite rotational direction 188 to the first rotational position shown in FIG. 13, and then extracted from the dispenser assembly. The first camming lobe 236 of the camming flange 234 is thus retracted from contact with first diluting valve 218, enabling the first diluting valve to close under the influence of spring 226 and the pressure of the first dilutant and cut off the flow of the dilutant through the first conduit.

Figure 18:
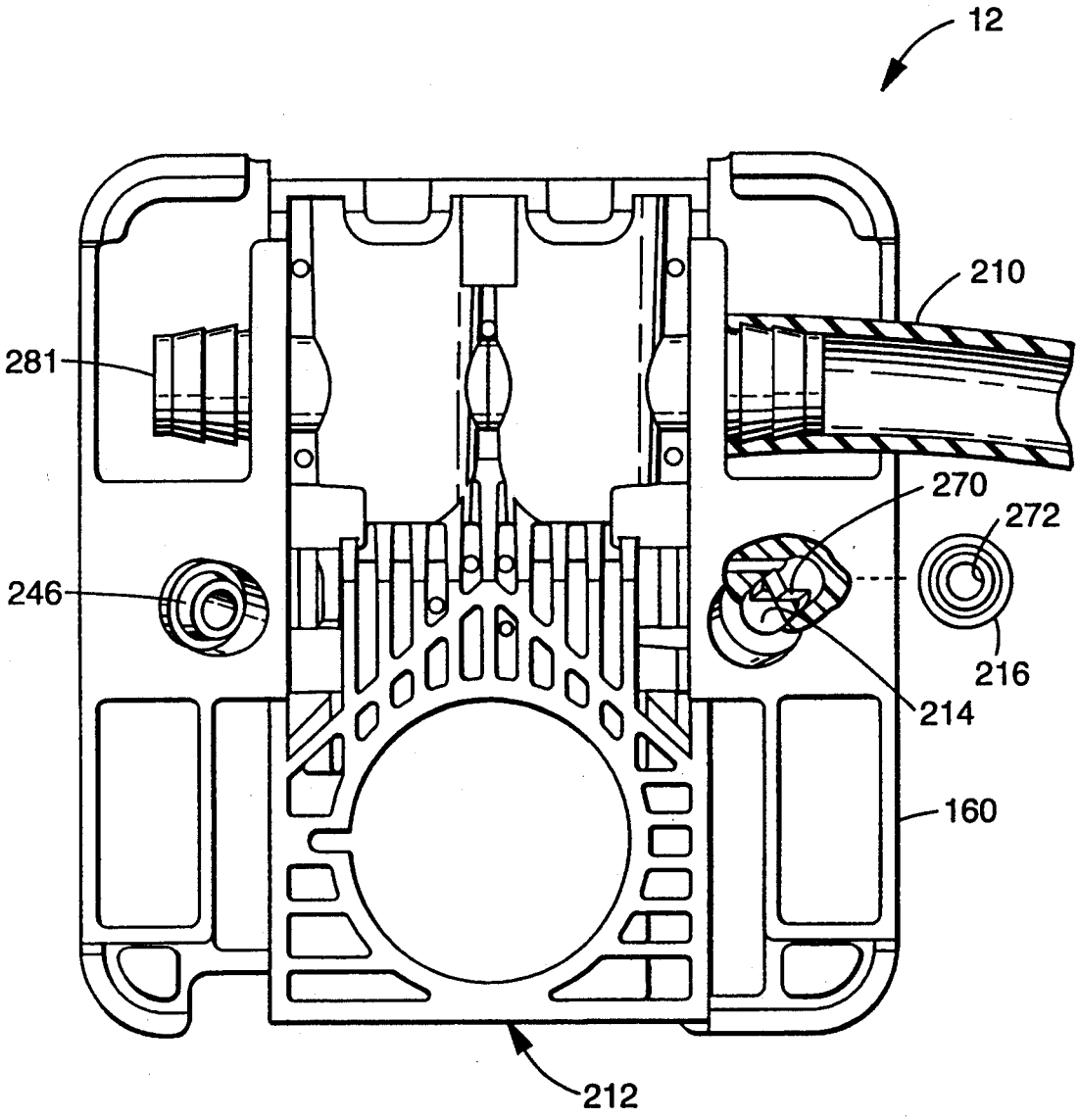
FIG. 18 is a cross sectional view, partially broken away, along plane 18—18 of the dispenser assembly of FIG. 1A.

AS is also shown in FIG. 13, a second conduit 244 may be formed in the dispenser assembly for conveying a second stream of a diluting fluid to the dispensing chamber 162. As in the case of the first conduit, the second conduit 244 extends generally horizontally and extends downwardly to a second nozzle 246 directed towards the fluid chamber (as shown in FIG. 18). The second conduit 244 is adapted for fluid connection to a source of a dilutant. In FIGS. 13 and 14, the second conduit 244 is commonly connected through a portion of the first conduit 214 to the same source of dilutant.

Figure 15:
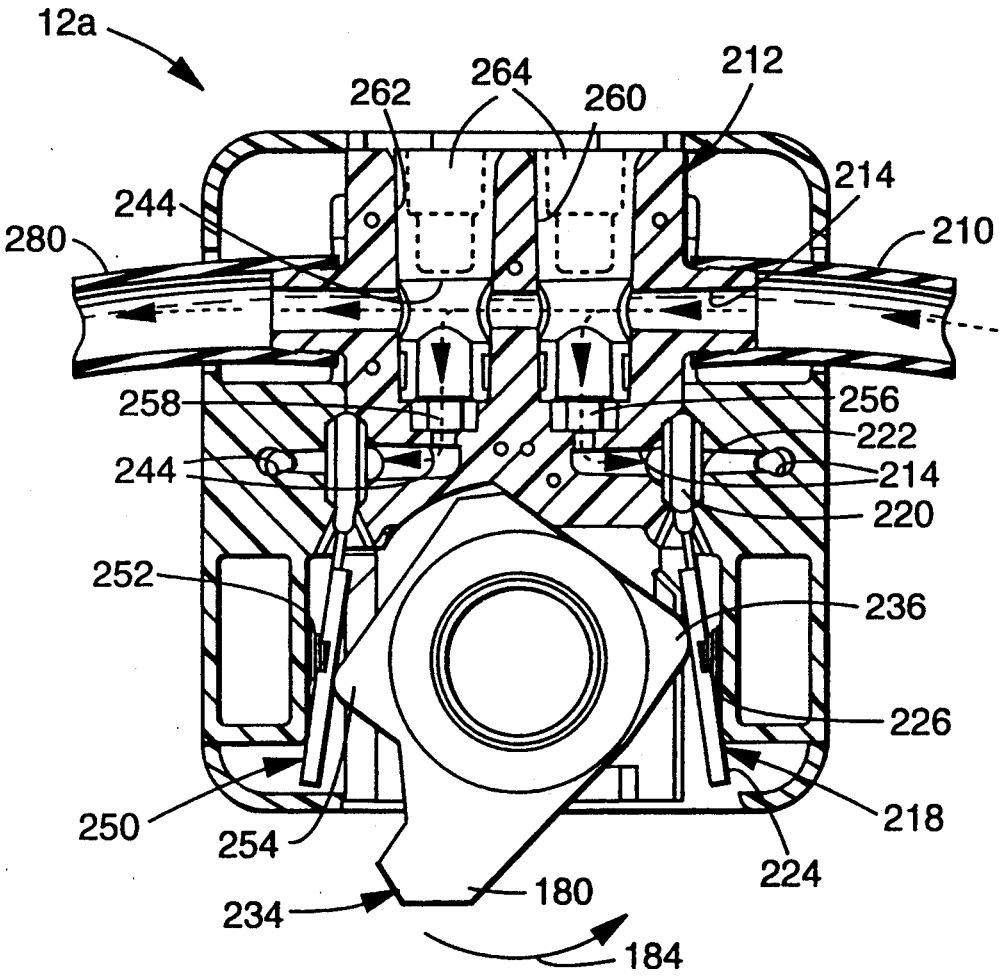
FIG. 15 is a cross sectional view of an alternate embodiment of the dispenser assembly, with a hose enabling the source of dilutant to be connected to another dispenser assembly.

Second diluting valve 250 is provided to control the dispensing of the dilutant through second conduit 244 and is likewise preferably a "banjo" type of valve substantially similar to the structure and operation of the first diluting valve and therefore will not be described in further detail. The second diluting valve is biased to a closed position by spring 252 and the pressure of the dilutant in the second conduit. Second diluting valve 250 is preferably axially aligned with the position of first diluting valve 214. If it desired to actuate the second diluting valve, the camming flange 234 may be provided with a second camming lobe 254 as shown in FIG. 15. The bottle 14 may be inserted, rotated and supported on the dispenser assembly 12 as described herein. This will automatically activate the flow of the dilutant through both conduits 214,244 into the fluid chamber 162.

Although the camming lobes 236,254 are illustrated in diametrically opposite positions, it will be recognized that the first and second diluting valves may be mounted in any desired rotational or axial position and the camming collar 234 and first and second camming lobes 236,254 arranged correspondingly. For instance, the first and second camming lobes may be mounted on separate camming flanges (not shown) and located at axially spaced locations.

It will be understood that if a second dilutant stream is not desired, the dispenser assembly may be constructed without a second conduit 244 or a second diluting valve 250, and operate as described with respect to FIGS. 13 and 14.

Figure 13B:
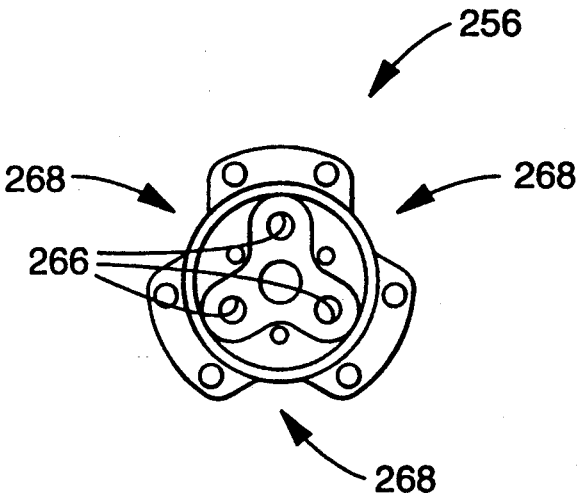
FIG. 13B is a magnified view of the first flow washer of FIG. 13.

Referring now again to FIGS. 13 and 14, a first flow washer 256 (shown in detail in FIG. 13B) is placed in the first conduit 214 between the first inlet hose 210 and the diluting chamber 162. Second flow washer 258, corresponding in structure to the first flow washer, is placed in a corresponding location in second conduit 244. Each of the flow washers 256, 258 may be inserted through passageways 260,262 formed in the dispenser assembly for that purpose, seated against shoulders or valve seats 259, and then sealed by threaded plugs and 0-ring seals 264, or by any other suitable arrangement known in the art.

Each of the first and second flow washers 256,258, may be configured as is found effective in independently regulating the flow rate through the first and second flow conduits. In the illustrated embodiment of the invention, the flow washers are generally cylindrical and have three concentric angularly spaced apertures 266 and three equidistant circumferential slots 268. Preferably, the flow washers are constructed of a resilient material, and most preferably, the flow washers are constructed of ethylene propylene, having a durometer of 70. In operation, the force of the dilutants encountering the flow washers will deform the flow washers in manner so as to gradually close off the slots 268 and restrict the apertures 266, thereby regulating the flow rate of the dilutant through the conduits.

By way of example, for a desired flow rate of 1.0 gallons per minute (such as for filling a hand held spray bottle of diluted concentrate), a flow washer having the 70 durometer material described above would be 0.170 inches in thickness and have a 0.490 inch outer diameter. The three apertures 266 would be 0.0508 inches in diameter and be located approximately 0.090 inches from the center of the flow washer. The peripheral slots 268 would each be 0.070 inches in depth, have a length of 0.250 inches. For a desired flow rate of 2.75 gallons per minute (such as for filling an open 5 gallon pail of diluted concentrate), a flow washer having the 70 durometer material described above would be substantially the same as described the flow washer described above, except that the apertures 266 would be 0.0705 inches in diameter.

Downstream of the flow washers, flow guides 270 are mounted in the first and second conduits 214,244. The flow guides 270 have a generally "S" shaped cross section, are constructed of a metallic material, and act to smooth out the flow of the fluid through the conduit. That is, the turbulence in the dilutant stream is reduced and the flow is more laminar in nature. This facilitates the dispensing of the dilutants into the fluid chamber at a steady, predictable rate. The dilutant streams are then expelled through first and second nozzles 216,246. The first and second nozzles are constructed of a polymeric material, such as polyphenolyn oxide, particularly Noryl 731 brand material available from General Electric Plastics and an internal aperture 272 having a diameter of 0.187 inches through which the dilutants are expelled into the fluid chamber 162.

It is one of the advantages of the present invention that a camming flange 234 may be provided with a first camming lobe 236 alone (as in FIGS. 13 and 14) that opens only the first diluting valve 218 to provide a first flow rate determined by the first flow washer 256; or a camming flange may be provided that includes the second camming lobe 254 alone (not shown) to open the second diluting valve 250 alone for a second, independent flow rate determined by the second flow washer 258, or a camming flange 234 may be provided with both lobes 236,254 (as in FIG. 15) to open both diluting valves 218,250 simultaneously, to provide a third, combined flow rate.

In the preferred embodiment of the invention, the camming flange 234 is integrally formed with the bottle 14 in a process called injection/blowmolding. That is, the main portion of the bottle is blow molded, but the neck portion and the camming collar are simultaneously injection molded. Alternatively, the camming flange may take the form of a separate planar member (not shown) with an aperture for receiving the neck portion of the bottle and secured in position by the valve cap 60.

FIG. 15 also illustrates an alternate embodiment 12*a* of the dispenser assembly in which a ganging hose 280 has been connected through the second conduit 244 so that the dilutant may be conveyed (or "ganged") to one or more additional dispenser assemblies (not shown), that may of the same design as the present invention, or any other suitable fluid dispensing design. In all other respects, the operation of the dispenser assembly 12*a* is as herein described. In the embodiment of the invention shown in FIGS. 13 and 14, access to the second conduit is blocked by plug 281, which may be removed to connect to ganging hose 280. This arrangement may be convenient in the case where a plurality of dispenser assembly may be located adjacent each other and a common dilutant is used, rather than providing multiple sources of the same dilutant or independently connecting each of the dispenser assemblies to the same source of dilutant.

Figure 16:
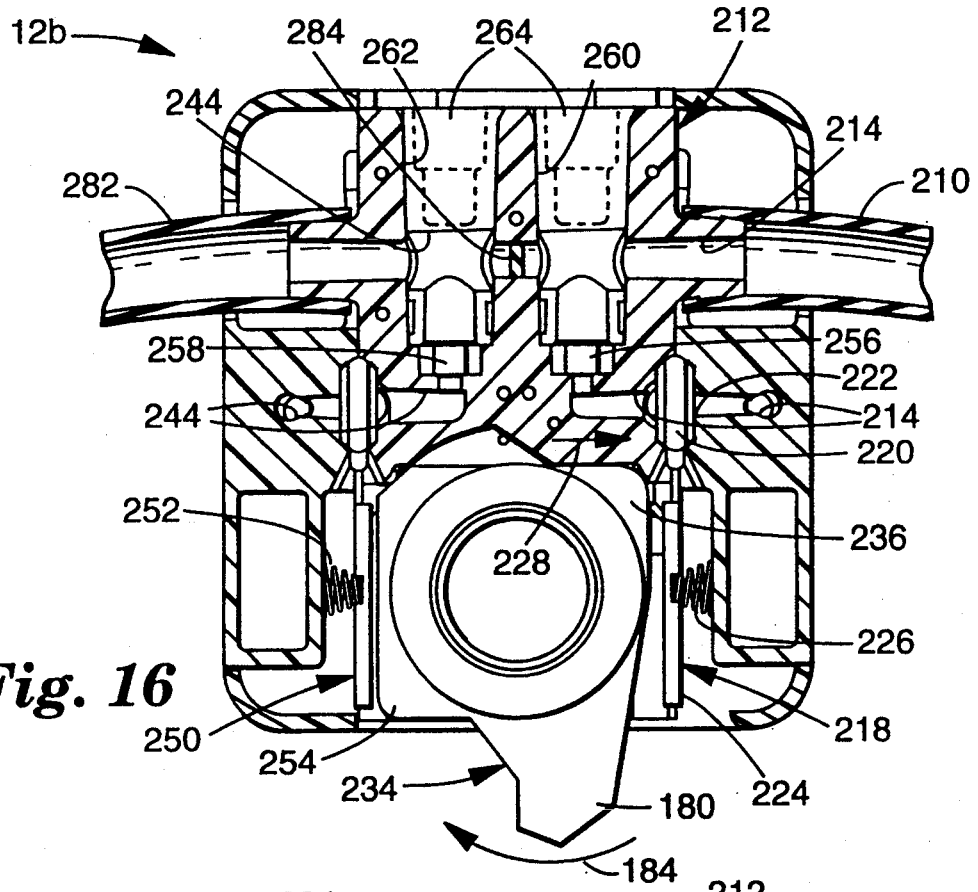
FIG. 16 is a cross sectional view of yet another alternate embodiment of the dispenser assembly, wherein the second conduit is connected to a source of a second dilutant and with a bottle inserted into the dispenser assembly, but not rotated into engagement.
Figure 17:
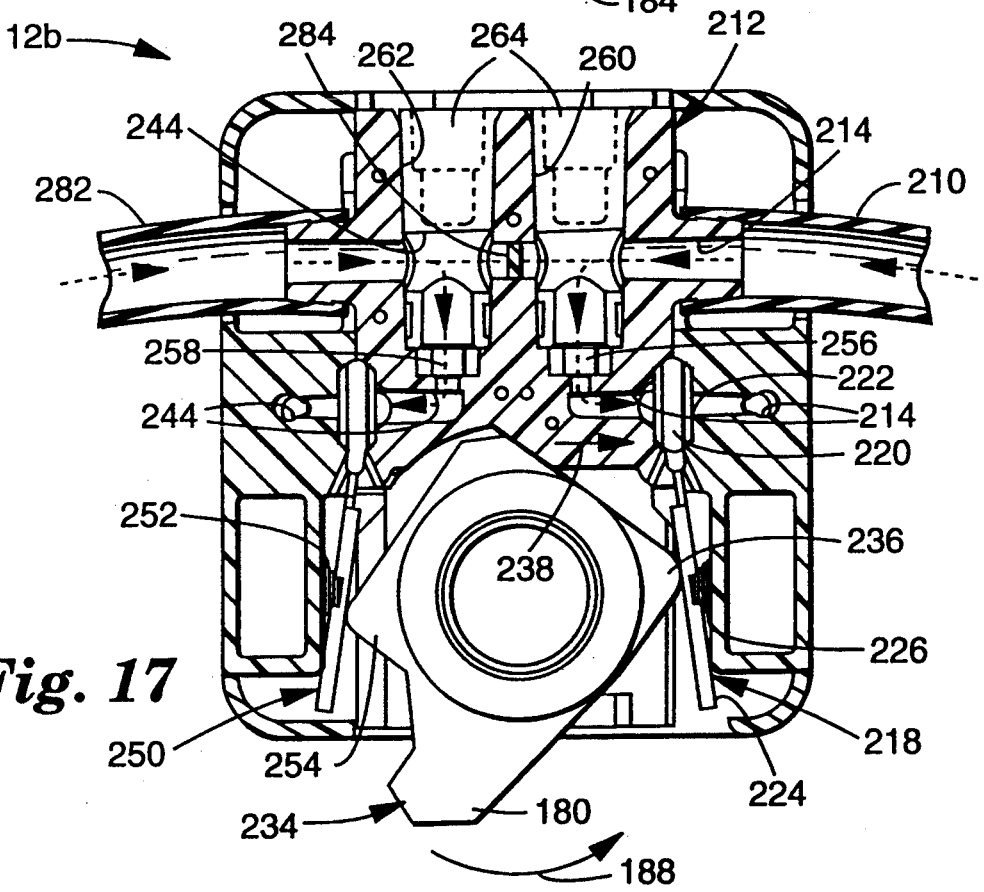
FIG. 17 is across sectional view of the alternate embodiment of the dispenser assembly of FIG. 16, with the bottle rotated into engagement with the dispenser assembly.

As shown in FIGS. 16 and 17, an alternate embodiment 12*b* of the dispenser assembly may includes a second inlet hose 282 connected to a second source (not shown) of a fluid, intended as a second dilutant. Second inlet hose 282 may be connected through second conduit 244, with plug 281 (shown in FIGS. 13 and 14) removed, to the fluid chamber 162. The first and second conduits 214,244 are divided by wall 284 to separate the first dilutant from the second dilutant until the fluid chamber 162. The present invention is thus useful for providing two different dilutant fluids, at independent flow rates, for mixing with the concentrate.

It will be recognized that the present invention may be similarly constructed with three or more sets of conduits, inlet hoses, sources of dilutants, diluting valves and camming flanges, as desired. Accordingly, camming flanges may be correspondingly devised to selectively actuate one, or any combination of more than one of the dilutant streams.

Figure 19:
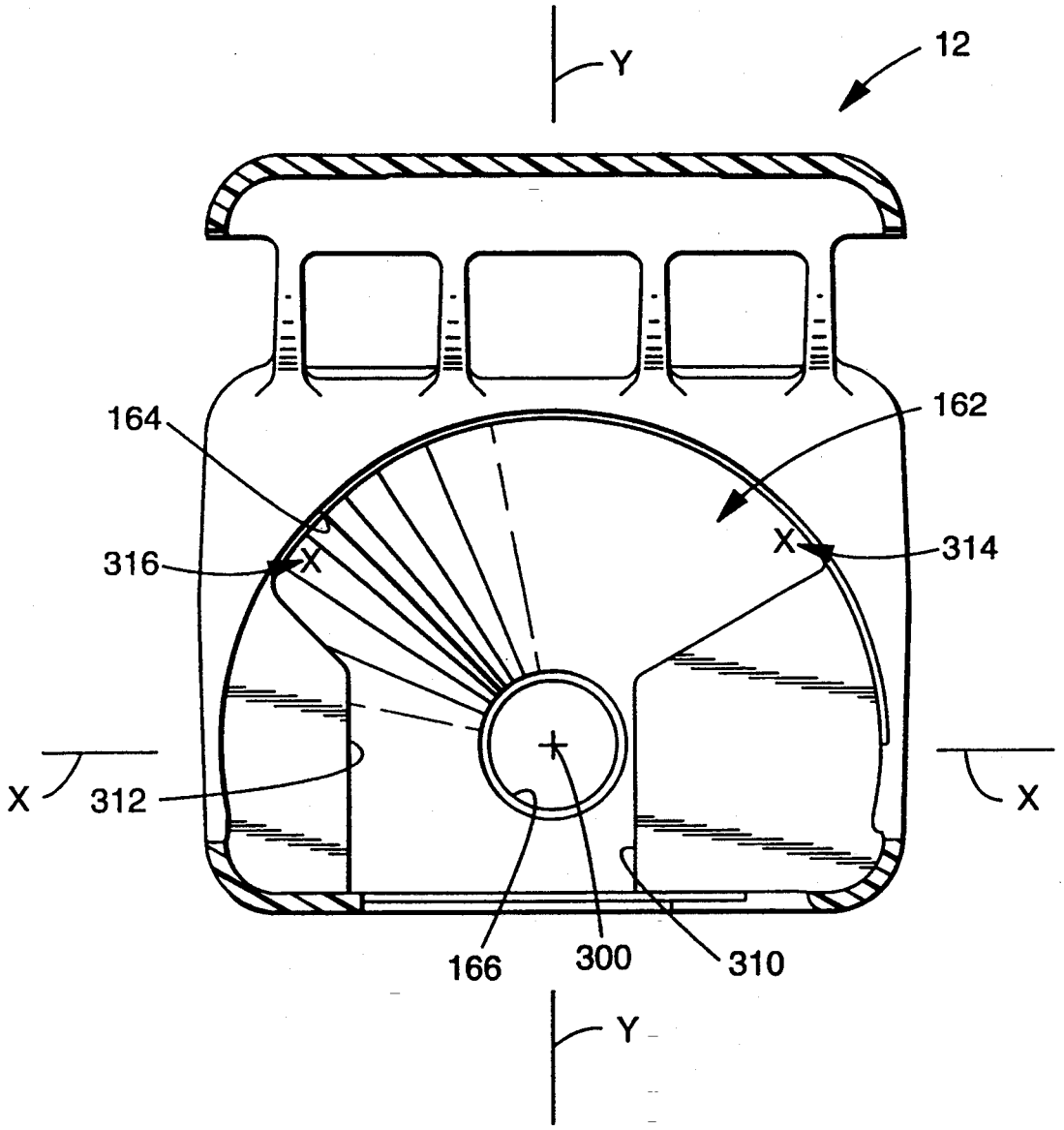
FIG. 19 is a top view of the fluid chamber of the dispenser assembly of FIGS. 1A and 1B.

As is more particularly shown in FIG. 19, fluid chamber 162 is preferably generally frusto-conical in shape and directed downwardly about a central axis 300, and defining an X-axis and Y-axis as shown. The fluid chamber has an upper, receiving opening having a nominal diameter of 4.50 inches and a lower, dispensing opening of 1.25 inches in diameter. The fluid chamber has a length of 2.88 inches and therefore, an angle of 30° with respect to the center line 300.

Figure 20:
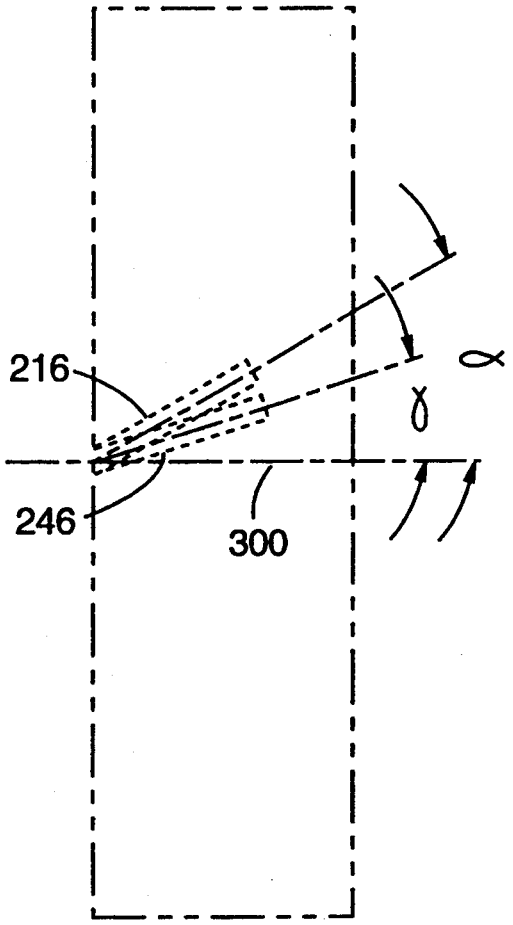
FIG. 20 is a schematic representation of the vertical angle of inclination of the first and second nozzles of the dispenser assembly with respect to the central axis of the dispenser assembly.
Figure 21:
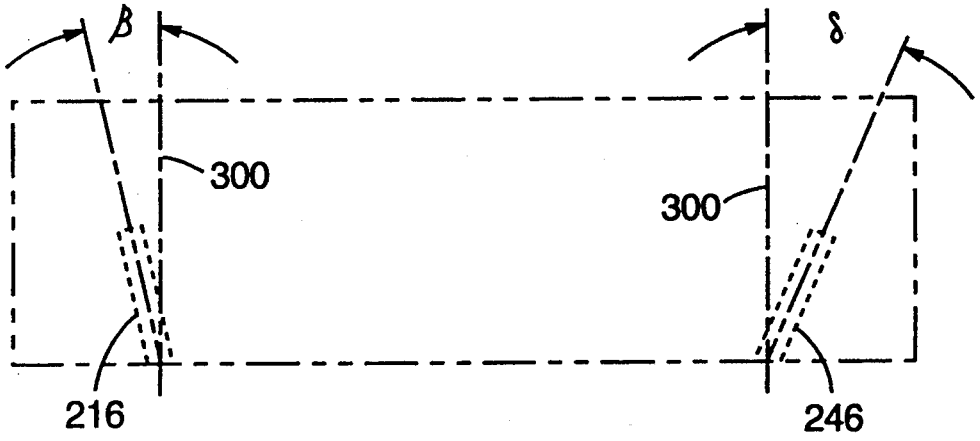
FIG. 21 is a schematic representation of the horizontal angle of inclination of the first and second nozzles of the dispenser assembly with respect to the central axis of the dispenser assembly.
Figure 22:
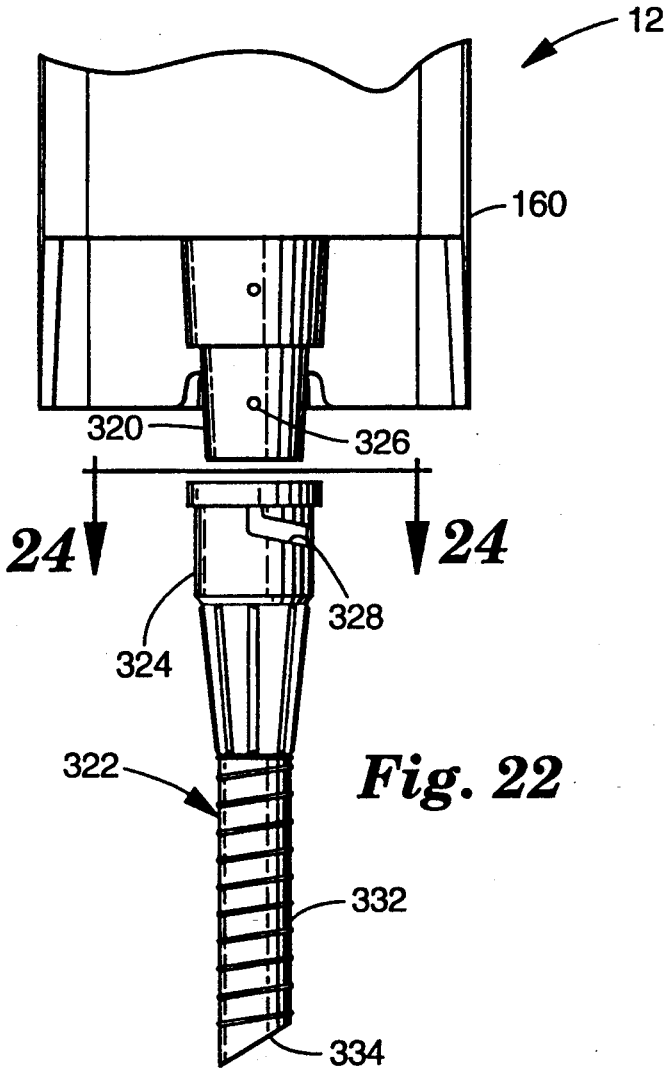
FIG. 22 is a front view of a first dispense hose aligned with the spout of the dispenser assembly of FIGS. 1A and 1B.

As is shown schematically in FIGS. 20 and 21, for a one gallon a minute flow rate of water, the location of first nozzle 216 (at 312 in FIG. 19) is spaced a distance of 2.03 inches along the X-axis and 1.50 inches on the Y-axis from the central axis 300 of the fluid chamber and an axial distance of 4.68 inches above the dispensing opening. The first nozzle 216 is oriented with respect to central axis 300 to direct the stream of first dilutant at an angle $\alpha$ of 59.5° in a horizontal plane and an angle $\beta$ of 11.5° in a vertical plane, so that the first dilutant enters the fluid chamber at a downwardly directed angle with respect to the center axis and is induced to follow a spiral path through the fluid chamber, where it encounters the concentrate and a mixture results, ultimately exiting the fluid chamber through dispensing opening 166.

Similarly, for the 1.75 gallon a minute flow rate, the second nozzle is spaced 1.78 inches on the X-axis on the opposite side of center point 300 from the first nozzle, 1.50 inches of the Y-axis on the same side as the first nozzle, and is positioned at the same axial location of 4.68 inches above the dispensing opening and directs the stream of second dilutant at an angle $\gamma$ of 73° in a horizontal plane and an angle $\delta$ of 17° in a vertical plane, both from central axis 300, so that the dilutant enters the fluid chamber at a downwardly directed angle with respect to the center axis without following a spiral path through the fluid chamber, where it encounters the concentrate and the first dilutant and a mixture results, ultimately exiting the fluid chamber through dispensing opening 166.

However, it is sometimes the nature of the concentrate and the dilutant (or dilutants) that upon mixture a foaming action occurs. If the foaming action is severe, the foamed material impedes the flow of the fluids through the dispenser assembly and the foamed mixture may spill out of the dispenser assembly, with adverse consequences. For that reasons, it is desirable to reduce the "residence time" of the fluids in the fluid chamber so that any foaming, if it occurs, occurs exteriorly of the dispenser assembly. Means are therefore provided to reduce the "residence time" of the dilutants within the fluid chamber. In the illustrated embodiment, the residence time reducing means includes a first baffle 310 extending into the frustoconical fluid chamber. The first dilutant stream follows a spiral path around the fluid chamber for less than one complete turn before the first baffle is encountered. The first dilutant stream is thus reduced in velocity and consequently falls in a more vertical path towards the dispensing opening 166. This reduces the residence time that would otherwise be spent following a spiral path to the dispensing opening as described above. The second dilutant stream follows a direct, non-spiral path to the dispensing opening and thus only a minimal residence time.

In the preferred embodiment of the invention, second baffle 312 is provided extending into the frustoconical fluid chamber. Second baffle 312 is provided to direct any "backsplash" from the first dilutant stream from exiting the fluid chamber. Instead, the backsplash encounters the second baffle and falls back into the fluid chamber towards dispensing opening 166.

Spout 320, shown in FIGS. 1A,1B, 22 and 23 communicates with dispensing opening 166 and depends downwardly therefrom. Spout 320 is adapted for connection to a dispense hose 322 or the like for conveying the diluted concentrate exteriorly of the dispenser assembly 12 for subsequent use. The dispense hose 322 includes an adapter member 324 including means for detachably securing and sealing the dispense hose to the spout.

In the illustrated embodiment, the securing and sealing means includes one or more pins 326 radially projecting from the spout. A corresponding "J" slot 328 is formed in the adapter member for each of the pins. One of the pins is received within the "J" slot and then the dispense hose is rotated with respect to the spout to lock and seal the dispense hose to the spout in a manner known in the art.

A first dispense hose 322 and adapter member 324 may be provided (shown in FIG. 22) having an internal diameter of 0.056 inches, suitable for a one gallon per minute flow rate. One or more second pins 330 are provided on a portion of the spout having a larger diameter, suitable for engagement with a like number of aligned "J" slots 328 in a second dispense hose 322*a* and adapter member 324*a* (shown in FIG. 23) having a larger internal diameter of 1.373 inches, suitable for a 2.75 gallon per minute flow rate. Thus multiple dispense hoses may be provided to use with a dispenser assembly, for use in conveying multiple flow rates of fluid.

The adapter members 324,324*a* and dispense hoses 322,322*a* are to be constructed of a material that is compatible with the fluids to be mixed and dispensed. Most preferably, the dispense hose and adapter member are constructed of high density polyethylene or polypropylene. The exterior of the dispense hose adjacent the adapter member may be resiliently reinforced with a spring like member 332. Preferably, the distal end 334 of the dispense hose is inclined (or otherwise configured, such perforated) to prevent interference with the bottom of a container (not shown) into which fluid is to be dispensed.

Figure 24:
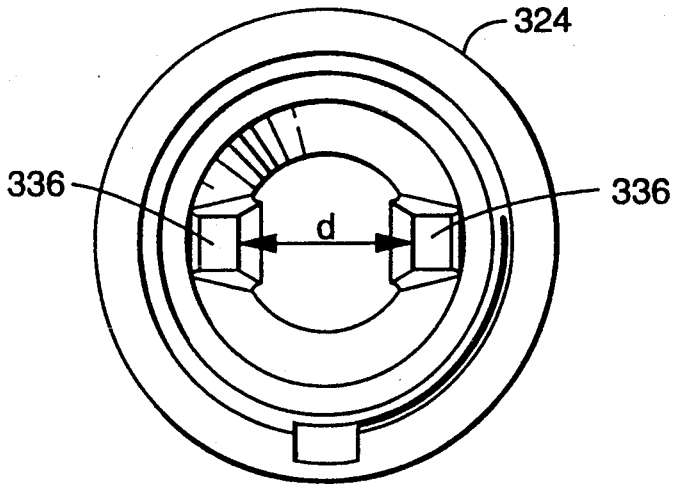
Figure 23:
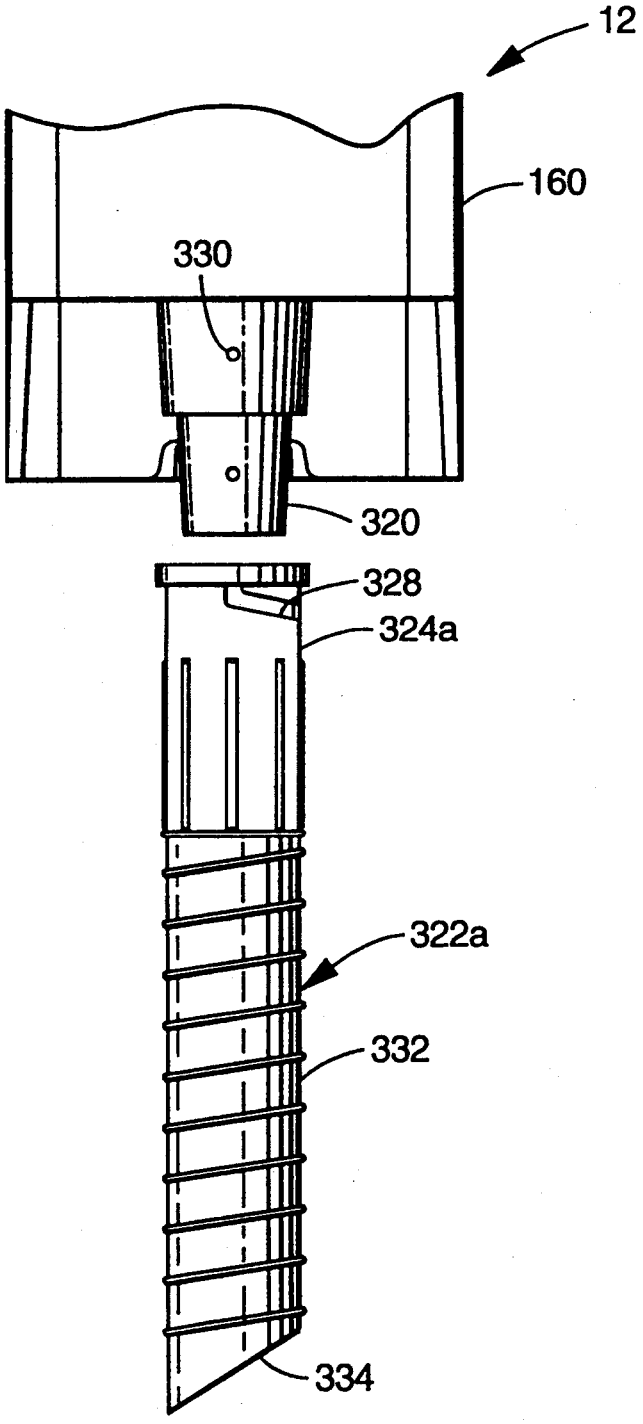
FIG. 23 is a front view of a second dispense hose aligned with the spout of the dispenser assembly of FIGS. 1A and 1B; and, FIG. 24 is a top view along plane 24—24 of the adapter member of FIG. 23.

The residence time reducing means also preferably includes one or more baffles 336, shown more particularly in FIG. 24 and radially extending radially inward within the adapter member 324. In the illustrated embodiment, two diametrically opposed baffles 336 are provided spaced apart at the upper end by a distance "d" of 0.44 inches. The adapter member baffles 336 act to at least partially disrupt the spiral vortex that the diluted concentrate follows and induces the mixture to follow a more vertical, and therefore quicker, path through the dispense hose, thereby further reducing the residence time in the fluid chamber.

It is one of the advantages of the present invention, that more accurate dispensing of fluids may be accomplished as compared to conventional fluid displacement systems. This is provided by utilizing a bottle that resists paneling, by a valve cap that accurately dispenses the concentrate, by a dispenser assembly that accurately meters the flow of the dilutant or dilutants, and by reducing the residence time of the fluids in the fluid chamber. The present invention also enables one or more dilutants to be delivered independently or in a combined manner. The gravity feed fluid dispensing system of the present invention eliminates the requirement of electrical power and provides a simple, reliable, inexpensive system that is adapted for remote operation and at low volumes.

The present invention has now been described with reference to multiple embodiments thereof. It will be apparent to those skilled in the art that many changes can be made in the embodiments described without departing from the scope of the present invention. For instance, it is within the spirit and scope of the present invention to provide a gravity feed fluid dispense system that dispenses only the concentrate in an accurate and consistent manner. This would eliminate the need for the portions of the system described herein for providing one or more dilutants. Thus, the scope of the present invention should not be limited to the structures described in this application, but only by structures described by the language of the claims and the equivalents of those structures.

What is claimed is:

1. A gravity feed fluid dispensing system for dispensing a fluid, comprising:

(a) a bottle having a cavity adapted for receiving a quantity of the fluid and an orifice communicating between said cavity and exteriorly of said bottle;

(b) a valve cap mounted on said bottle about said orifice for controlling flow of the fluid, said valve cap being shiftable between a first, closed position preventing flow of the fluid from the bottle, and a second, open position for dispensing the fluid from the bottle through said orifice at a predetermined rate;

(c) a dispenser assembly for supporting said bottle while dispensing the fluid, said dispenser assembly including a body having a chamber, a receiving opening above said chamber and a dispensing opening below said chamber, said receiving opening and said dispensing opening each communicating with said chamber, supporting means for engaging and supporting said bottle on said body with said orifice of said bottle directed downwardly through said receiving opening to said chamber, wherein shifting said valve cap to said open position enables the fluid to be dispensed from said bottle and outwardly from said dispenser assembly through said dispensing opening;

(d) means for shifting said valve cap on said bottle from said closed position to said open position to enable dispensing of the fluid, said shifting means being actuated when said bottle is engaged with said supporting means;

(e) means adapted for connection to a source of a first diluting fluid and for conveying the first diluting fluid through a first conduit from a first to a second end thereof formed in said dispenser assembly, to said chamber;

(f) a first diluting valve for controlling the flow of the first diluting fluid though said first conduit into said chamber, shiftable between an open position enabling flow of the first diluting fluid into said chamber, and a closed position preventing flow of the first diluting fluid into the chamber, said first diluting valve being biased to said closed position; and (g) camming means for shifting said first diluting valve to said open position responsive to said bottle being received by and engaged with said supporting means of said dispenser body, and adapted to enable the first diluting fluid to flow into said chamber, whereby the fluid from said bottle and the first diluting fluid will intermix in said chamber and flow outwardly of said dispenser assembly though said dispensing opening.

2. The fluid dispensing system of claim 1, wherein said camming means includes a camming flange projecting from said bottle including a first camming lobe for contacting said first diluting valve and shifting said first diluting valve to said open position, when said bottle is engaged with said supporting means.

3. The fluid dispensing system of claim 1, wherein said bottle includes a pair of laterally spaced, parallel gripping surfaces adapted for manual engagement for manipulating said bottle between an upright position with said orifice directed upwardly, and an inverted position with said orifice directed downwardly for engagement with said supporting means of said dispenser assembly.

4. The fluid dispensing system of claim 3, wherein said bottle further includes stiffening means to resist paneling.

5. The fluid dispensing system of claim 4, wherein said stiffening means includes a shoulder formed between each of said gripping surfaces and said orifice for stiffening said bottle to resist paneling while the fluid is dispensed.

6. The fluid dispensing system of claim 5, wherein said stiffening means further includes a plurality of parallel ribs projecting from said gripping surfaces.

7. The fluid dispensing system of claim 3, wherein said gripping surfaces each include a plurality of parallel ribs to facilitate manual engagement of said bottle when shifting said bottle between said upright position and said inverted position.

8. The fluid dispensing system of claim 1, further including:

means adapted for connection to a source of a second diluting fluid and for conveying the second diluting fluid through a second conduit to said chamber;

a second diluting valve for controlling the flow of the second diluting fluid through said second conduit into said chamber, shiftable between an open position enabling flow of the second diluting fluid into said chamber, and a closed position preventing flow of the second diluting fluid through said second conduit into said chamber, said second diluting valve being biased to said closed position; and second camming means for shifting said second diluting valve to said open position responsive to said bottle being received by and engaged with said supporting means of said dispenser body, to enable the second diluting fluid to flow through said second conduit into said chamber, whereby the fluid from said bottle and the second diluting fluid will intermix in said chamber and flow outwardly of said dispenser assembly though said dispensing opening.

9. The fluid dispensing system of claim 8, wherein said second camming means includes:

a second camming lobe on said camming flange of said bottle for contacting said second diluting valve for shifting said second diluting valve to said open position, when said bottle is engaged with said supporting means.

10. The fluid dispensing system of claim 8, wherein said first conduit and said second conduit are in fluid communication with each other to enable the first diluting fluid to flow through said first conduit to said chamber and through said second conduit to said chamber.

11. The fluid dispensing system of claim 8, wherein said second conduit is connected to a second inlet hose, said second inlet hose adapted for connection to a source of a second diluting fluid and wherein said first conduit and said second conduit are blocked from communicating with each other.

12. The fluid dispensing system of claim 1, wherein said supporting means enables said inverted bottle to be inserted into said receiving opening of said fluid chamber in a first rotational position, and then rotated in a first rotational direction to a second rotational position wherein said bottle is engaged and supported by said supporting means, and wherein said bottle may be rotated in an opposing, second rotational direction to said first rotational position and disengaged from said supporting means and removed from said dispenser assembly.

13. The fluid dispensing system of claim 1, wherein said valve cap on said bottle includes an insert portion mounted on said bottle about said orifice and a cooperative cap mounted on said insert and rotationally shiftable with respect to said insert between a first position in which said cap and insert cooperatively seal said orifice, and a second position in which said orifice is not sealed by said cap and said insert, enabling the fluid to be dispensed from said bottle.

14. The fluid dispensing system of claim 13, wherein said means for shifting said valve from said closed position to said open position by rotationally shifting said cap with respect to said insert on said bottle from said closed position to said open position, is automatically actuated when said bottle is engaged with said supporting means in said second rotational position, and includes a radially extending keyway formed in said dispenser assembly body and further including a cooperative aligned radially extending key on said cap of said valve cap, whereby when said inverted bottle, with said valve cap in said closed position, is inserted into said first rotational position with respect to said supporting means, said key is engaged with said keyway, and when said bottle is rotated to said second rotational position and engaged with said supporting means, said cap is maintained stationary as said insert is rotated with said bottle so as to shift said valve cap to said open position.

15. The fluid dispensing system of claim 1, further including means for reducing the residence time of the fluid and the first diluting fluid in said chamber.

16. The fluid dispensing system of claim 15, wherein said chamber is generally frusto-conical and wherein said residence reducing means includes a baffle radially projecting inward in said chamber, wherein said baffle is adapted to encounter the fluid and the first diluting fluid in said chamber, thereby interrupting the path of the fluid and the first diluting fluid within said chamber and inducing the fluid and the first diluting fluid to flow through more rapidly said dispensing opening.

17. The fluid dispensing system of claim 16, further including a second baffle projecting into said chamber, wherein said second baffle is adapted to encounter backsplash from the fluid and the first fluid in said chamber, thereby inducing the backsplash to more rapidly flow through said dispensing opening.

18. The fluid dispensing system of claim 1, further including a dispense hose mounted on an adapter member on one end, said adapter member attachable to a spout mounted on said dispenser assembly and communicating with said dispensing opening of said dispenser assembly, to enable said fluid to flow from said chamber outwardly of said dispenser assembly.

19. The dispenser assembly of claim 18 further including means for reducing the residence time of fluid in said adapter member, wherein said residence reducing means includes at least one baffle extending radially inward in said adapter member, wherein the fluid flowing through said adapter member encounters said adapter member baffle and is induced to flow more rapidly through said dispense hose.

20. The fluid dispensing system of claim 1, further including a first flow washer mounted in said first conduit adapted to regulate the flow rate of the first diluting fluid through said first conduit to a first desired flow rate.

21. The fluid dispensing system of claim 20, further including a second flow washer mounted in said second conduit adapted to regulate the flow rate of the second diluting fluid through said second conduit to a second desired flow rate.

22. The fluid dispensing system of claim 1, further including a first flow guide mounted in said first conduit adjacent said second end adapted to reduce turbulence in the flow of the first diluting fluid therethrough.

23. The fluid dispensing system of claim 22, further including a second flow guide mounted in said second conduit adjacent said second end adapted to reduce turbulence in the flow of the second diluting fluid therethrough.

24. A dispenser assembly adapted for use with a gravity feed fluid dispensing system, the fluid dispensing system including a bottle having a cavity for receiving a quantity of the fluid and an orifice communicating between the cavity and exteriorly of the bottle, a valve cap mounted on the bottle about the orifice for controlling flow of the fluid, the valve cap being shiftable between a first, closed position preventing flow of the fluid from the bottle, and a second, open position for dispensing the fluid from the bottle through the orifice at a predetermined rate, and at least one source of a diluting fluid, the dispenser assembly comprising:

(a) a dispenser assembly body having a chamber, a receiving opening above said chamber and a dispensing opening below said chamber, said receiving opening and said dispensing opening each communicating with said chamber, (b) supporting means adapted for engaging and supporting the bottle on said body with the orifice of the bottle directed downwardly through said receiving opening to said chamber, wherein shifting the valve cap to the open position enables the fluid to be dispensed from the bottle and outwardly from said dispenser assembly through said dispensing opening;

(d) means adapted for shifting the valve cap on the bottle from the closed position to the open position to enable dispensing of the fluid, said shifting means being actuated when the bottle is engaged with said supporting means;

(e) means adapted for connection to one of the sources of a first diluting fluid and for conveying the first diluting fluid through a first conduit from a first to a second end thereof formed in said dispenser assembly, to said chamber;

(f) a first diluting valve adapted for controlling the flow of the first diluting fluid though said first conduit into said chamber, shiftable between an open position enabling flow of the first diluting fluid into said chamber, and a closed position preventing flow of the first diluting fluid into the chamber, said first diluting valve being biased to said closed position; and (g) cam engaging means adapted for shifting said first diluting valve to said open position responsive to the bottle being received by and engaged with said supporting means of said dispenser body, and adapted to enable the first diluting fluid to flow into said chamber, whereby the fluid from the bottle and the first diluting fluid will intermix in said chamber and flow outwardly of said dispenser assembly through said dispensing opening.

25. The dispenser assembly of claim 24, wherein said cam engaging means includes:

a first diluting valve arm connected to said first diluting valve and adapted to be engaged by a camming flange projecting from the bottle and including a first camming lobe adapted for contacting said first diluting valve arm and thereby shifting said first diluting valve to said open position, when the bottle is engaged with said supporting means.

26. The dispenser assembly of claim 24, further including:

means adapted for connection to a source of a second diluting fluid and for conveying the second diluting fluid through a second conduit to said chamber;

a second diluting valve adapted for controlling the flow of the second diluting fluid through said second conduit into said chamber, shiftable between an open position enabling flow of the second diluting fluid into said chamber, and a closed position preventing flow of the second diluting fluid through said second conduit into said chamber, said second diluting valve being biased to said closed position; and second cam engaging means adapted for shifting said second diluting valve to said open position responsive to the bottle being received by and engaged with said supporting means of said dispenser body, to enable the second diluting fluid to flow through said second conduit into said chamber, whereby the fluid from the bottle and the second diluting fluid will intermix in said chamber and flow outwardly of said dispenser assembly though said dispensing opening.

27. The dispenser assembly of claim 26, wherein said second cam engaging means includes:

a second diluting valve arm connected to said second diluting valve and adapted to be engaged by a second camming lobe on the camming flange projecting from the bottle, for contacting said second diluting valve arm and thereby shifting said second diluting valve to said open position, when the bottle is engaged with said supporting means.

28. The dispenser assembly of claim 26, further including a flow washer mounted in said second conduit adapted to regulate the flow rate of the second diluting fluid through said second conduit to a desired flow rate.

29. The dispenser assembly of claim 26, further including a flow guide mounted in said second conduit adjacent said second end adapted to reduce turbulence in the flow of the second diluting fluid therethrough.

30. The dispenser assembly of claim 26, wherein said first conduit and said second conduit are in fluid communication with each other to enable the first diluting fluid to flow through said first conduit to said chamber and through said second conduit to said chamber.

31. The dispenser assembly of claim 26, wherein said second conduit is connected to a second inlet hose, said second inlet hose adapted for connection to a source of a second diluting fluid, and wherein said first conduit and said second conduit are blocked from communicating with each other.

32. The dispenser assembly of claim 24, wherein said supporting means is adapted to support the inverted bottle when the bottle is inserted into said receiving opening of said chamber in a first rotational position, and then rotated in a first rotational direction to a second rotational position wherein the bottle is engaged and supported by said supporting means, and wherein the bottle may be rotated in an opposing, second rotational direction to said first rotational position and disengaged from said supporting means and removed from said dispenser assembly.

33. The dispenser assembly of claim 24, further including means for reducing the residence time of the fluid and the first diluting fluid in said chamber.

34. The dispenser assembly of claim 33, wherein said chamber is generally frusto-conical and wherein said residence reducing means includes a baffle radially projecting inward in said chamber adapted to encounter the fluid and the first diluting fluid in said chamber, thereby interrupting the path of the fluid and the first diluting fluid in said chamber and inducing the first diluting fluid to flow more rapidly through said dispensing opening.

35. The dispenser assembly of claim 34, further including a second baffle projecting into said chamber, adapted to encounter backsplash from the fluid and the first diluting fluid in said chamber, thereby inducing the backsplash to flow more rapidly through said chamber to said dispensing opening.

36. The dispenser assembly of claim 24, further including a dispense hose mounted on an adapter member on one end, said adapter member attachable to a spout mounted on said dispenser assembly and communicating with said dispensing opening of said dispenser assembly, to enable fluid to flow from said chamber outwardly of said dispenser assembly.

37. The dispenser assembly of claim 36 further including means for reducing the residence time of fluid in said dispense hose, wherein said residence reducing means includes at least one baffle extending radially inward in said adapter member, wherein the fluid flowing through said adapter member encounters said adapter member baffle whereby the fluid is induced to flow more rapidly through said dispense hose.

38. The dispenser assembly of claim 24, further including a first flow washer mounted in said first conduit adapted to regulate the flow rate of the first diluting fluid through said first conduit to a first desired flow rate.

39. The dispenser assembly of claim 24, further including a first flow guide mounted in said first conduit adjacent said second end adapted to reduce turbulence in the flow of the first diluting fluid therethrough.

40. The dispenser assembly of claim 24, further including a bottle containing a quantity of fluid to be dispensed.

* * * * *

UNITED STATES PATENT AND TRADEMARK OFFICE

CERTIFICATE OF CORRECTION

PATENT NO. : 5,425,404

DATED : June 20, 1995

INVENTOR(S) : John J. Dyer

It is certified that error appears in the above-indentified patent and that said Letters Patent is hereby corrected as shown below:

Col. 1, line 17, delete "Co.".

Col. 2, line 34, after "flow of the", insert --diluting--.

Col. 2, line 34, delete "dilution chamber" and insert therefor --fluid chamber--.

Col. 2, line 43, delete "though" and insert therefor --through--.

Col. 3, line 45, delete "across" and insert therefor --a cross--.

Col. 4, line 52, between the words "fluid" and "By" insert --.--.

Col. 7, line 65, after "position, and" delete the word "the".

Col. 8, line 54, delete "which as been" and insert therefor --which has been--.

Col. 10, line 56, delete "the fluid to the dilution chamber" and insert therefor --the dilutant to the fluid chamber--.

Col. 11, line 31, delete "AS" and insert therefor --As--.

Col. 12, line 7, delete "diluting chamber" and insert therfor --fluid chamber--.

Col. 13, line 22, between the words "may" and "of" insert --be--.

Col. 13, line 36, delete "includes" and insert therefor --include--.

Col. 14, line 32, delete "reasons" and insert therefor --reason--.

UNITED STATES PATENT AND TRADEMARK OFFICE

CERTIFICATE OF CORRECTION

PATENT NO. : 5,425,404

DATED : June 20, 1995

INVENTOR(S) : John J. Dyer

It is certified that error appears in the above-indentified patent and that said Letters Patent is hereby corrected as shown below:

Col. 16, line 57, delete "though" and insert therefor --through--.

Col. 17, line 41, delete "though" and insert therefor --through--.

Col. 19, line 51, delete "though" and insert therefor --through--.

Col. 20, line 30, delete "though" and insert therefor --through--.

Signed and Sealed this

Thirteenth Day of May, 1997

*Attest:*

Bruce Lehman

BRUCE LEHMAN

*Attesting Officer*

*Commissioner of Patents and Trademarks*

UNITED STATES PATENT AND TRADEMARK OFFICE
Certificate

Patent No. 5,425,404 Patented: June 20, 1995

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: John J. Dyer, Shoreview, Minn.; and Duncan M. Toll, Wilton, Conn.

Signed and Sealed this Seventh day of January 2003.

GREGORY L. HUSON
*Supervisory Patent Examiner*
Art Unit 3751